US009447524B2

(12) United States Patent
Masuda et al.

(10) Patent No.: US 9,447,524 B2
(45) Date of Patent: Sep. 20, 2016

(54) SEA ISLANDS FIBER

(75) Inventors: Masato Masuda, Mishima (JP); Joji Funakoshi, Otsu (JP)

(73) Assignee: Toray Industries, Inc. (JP)

( * ) Notice: Subject to any disclaimer, the term of this patent is extended or adjusted under 35 U.S.C. 154(b) by 66 days.

(21) Appl. No.: 14/237,368

(22) PCT Filed: Jul. 24, 2012

(86) PCT No.: PCT/JP2012/068652

§ 371 (c)(1),
(2), (4) Date: Mar. 4, 2014

(87) PCT Pub. No.: WO2013/021809

PCT Pub. Date: Feb. 14, 2013

(65) Prior Publication Data

US 2014/0193640 A1 Jul. 10, 2014

(30) Foreign Application Priority Data

Aug. 11, 2011 (JP) ..... 2011-176060

(51) Int. Cl.
*D01F 8/04* (2006.01)
*D01D 5/36* (2006.01)

(52) U.S. Cl.
CPC *D01F 8/04* (2013.01); *D01D 5/36* (2013.01); *Y10T 428/2933* (2015.01)

(58) Field of Classification Search
CPC ..... D01F 8/04; D01D 5/36
USPC ..... 428/375, 365, 373, 397, 401; 442/189, 442/201, 340, 341, 347, 351, 363
See application file for complete search history.

(56) References Cited

U.S. PATENT DOCUMENTS 7,025,915 B2 * 4/2006 Wang et al. ..... 264/103
7,622,188 B2 * 11/2009 Kamiyama et al. ..... 428/370
2004/0045145 A1 3/2004 Wang et al.

FOREIGN PATENT DOCUMENTS

JP 05-331711 A 12/1993
JP 07-118977 A 5/1995
JP 08-158144 A 6/1996
JP 2002-180329 A 6/2002
JP 2007-262610 A 10/2007
WO 2005/095686 A1 10/2005
WO 2011/093331 A1 8/2011

OTHER PUBLICATIONS

Supplementary European Search Report issued Feb. 10, 2015 from corresponding European Application No. 12822083.7.

* cited by examiner

*Primary Examiner* — Arti Singh-Pandey
(74) *Attorney, Agent, or Firm* — DLA Piper LLP (US)

(57) ABSTRACT

An islands-in-sea fiber includes island components and a sea component arranged to surround the island components, wherein the island components and the sea component are composed of at least two polymers and are provided on a fiber cross-section in a direction perpendicular to the fiber axis. The islands-in-sea fiber is a raw yarn for a combined filament yarn, which can be used to produce a cloth having good tension and drape and an excellent color-developing property. An islands-in-sea fiber in which at least two types of island components having different diameters are arranged on the same fiber cross section, the islands-in-sea fiber characterized in that at least one type of the island components have diameters of 10-1000 nm and have fluctuations in diameters of 1.0-20.0%.

7 Claims, 6 Drawing Sheets

SEA ISLANDS FIBER

TECHNICAL FIELD

This disclosure relates to a sea-island composite fiber including two or more polymers and having a structure such that the cross section perpendicular the fiber axis contains island domains and a sea domain surrounding them. The sea-island composite fiber may be used to produce a high-function fabric higher in quality stability and post-processability than any conventional fiber.

BACKGROUND

Fibers produced from thermoplastic polymers such as polyesters and polyamides have high dimensional stability and good mechanical properties. Accordingly, they are widely used for building interior decoration, vehicle interior decoration, and other industrial products, as well as apparel products. However, as fibers come into wider use, they are now required to meet varied characteristics requirements and, accordingly, different techniques have been proposed to provide fibers having special cross-sectional features to achieve sensitivity effects such as texture and bulkiness. In particular, the "ultrafineness" of fibers has a large effect on the characteristics of the fibers themselves and the characteristics of the fabrics produced therefrom. Therefore, these techniques represent the mainstream technology in terms of control of cross-sectional morphology of fibers.

If single component fiber spinning is applied to production of an ultrafine fiber, it will be impossible to obtain a fiber with a diameter smaller than about several micrometers even if spinning conditions are controlled with high accuracy. Thus, the multicomponent fiber spinning technique has been employed to convert a sea-island composite fiber into an ultrafine fiber. This technique is designed to first form a fiber with a cross section in which a plurality of island domains of a poorly soluble component disposed in a sea domain of a highly soluble component. Subsequently, the sea component is removed from the fiber or a fiber product formed therefrom to produce an ultrafine fiber composed of the island component. Currently, this sea-island spinning technique has been improved to produce ultrafine fibers (nanofibers) having a nano-level extreme fineness.

Fibers with a monofilament diameter of several hundreds of nanometers have unique features such as soft touch and texture that cannot be achieved in common fibers with diameters of several tens of micrometers or ultrafine fibers (micro-fibers) with diameters of several micrometers. Therefore, they can serve to produce such products as artificial leather and new tactile textiles, and they also serve to manufacture sports clothing that requires windproofness and water repellency, by taking advantage of their dense fiber structures. Nanofibers, furthermore, are able to get into very small grooves while increasing in specific surface area, and they can capture contaminants very efficiently in their extremely small interfiber gaps. With these characteristics, nanofibers have been used as industrial materials for wiping cloth and precision polishing cloth for precision equipment.

Having minimal fineness, as described above, these nanofibers can exhibit excellent quality. Nevertheless, they have some disadvantages such as poor mechanical characteristics including low resilience and bending strength. From the viewpoint of material mechanics, a simple decrease in fiber diameter causes a decrease in geometrical moment of inertia (material stiffness) in proportion to the fourth power of the fiber diameter. As a result, nanofibers by themselves have been useful for only limited applications as fiber products.

To solve this problem, Japanese Unexamined Patent Publication (Kokai) No. 2007-262610 proposes a technique for after-intermingling of a sea-island composite fiber that can form an ultrafine fiber (nanofiber) with an average fiber diameter of 50 to 1,500 nm and a general purpose fiber with a single fiber fineness of 1.0 to 8.0 dtex (about 2,700 to 9,600 nm).

It is true that the technique proposed in JP '610 seems to be able to provide fabric with improved mechanical characteristics because filaments with larger diameters will have major influence on the mechanical characteristics (for instance, resilience and bending strength) of fabrics produced therefrom.

In the technique proposed in JP '610, however, a fiber with a large diameter is used with a sea-island composite fiber to produce a combined filament yarn first, and then this combined filament yarn is interlaced, followed by carrying out sea removal treatment. This leads to a large unevenness in the distribution of nanofiber filaments in the cross-sectional direction or plane direction of the fabric. As a result, fabrics produced by the technique proposed by JP '610 are partially uneven in mechanical characteristics (such as resilience and bending strength) and water absorption capability. This is a disadvantage in applying the technique to manufacturing clothing. In the case of lining and other materials that come into direct contact with the skin, in particular, such a fabric can cause an uncomfortable sensation due to the peculiar texture of nanofiber. As a natural consequence, furthermore, such a fabric is also partially uneven in surface characteristics. This makes it very difficult to successfully apply such a fabric to high accuracy polishing material and wiping cloth that require high uniformity. This results from the temporal state where mutually independent sea-island composite fiber (groups of ultrafine filaments) and other fibers coexist in a pseudo-restraint condition in the fabric and, accordingly, it cannot be avoided as long as the after-intermingling technique is used.

To prevent an uneven distribution of ultrafine fibers caused by after-intermingling as described above, an effective method may be first forming a sea-island composite fiber having a cross section in which islands with large fiber diameters (island diameters) and those with small fiber diameters coexist and subsequently producing a fabric by interlacing this sea-island composite fiber, followed by removing the sea component, as proposed by Japanese Unexamined Patent Publication (Kokai) No. HEI 5-331711 and Japanese Unexamined Patent Publication (Kokai) No. HEI 7-118977.

JP '711 proposes a technique for composite fibers with uneven fineness having a cross section of a sea-island structure with a fineness of 1.8 denier (13,000 nm) or more in the outer portion and a fineness of 1 denier (10,000 nm) or less in the inner portions, with the fiber in the outer portion having a fineness three times or more that of the fiber in the inner portions.

Thus, the technique proposed in JP '711 provides products which, after removal of the sea component, contain fibers with large diameters in the outer portions and fibers with small diameters in the inner portions. The technique can produce a combined filament yarn with a cross section having a pseudo-porous structure. Capillarity of this porous structure serves to allow water on the surface of a combined filament yarn to move quickly. Fabrics produced from this combined filament yarn, therefore, can serve to provide a comfortable textile.

In the case of using the technique proposed in JP '711, however, water existing near the surface of the combined filament yarn is pulled into (absorbed by) the combined filament yarn. Accordingly, in a high temperature, high humidity atmosphere, moisture will be accumulated in the combined filament yarn although the humidity inside the clothes can be decreased temporarily in the initial period. Finally, the entirety of the cloth will become moist, resulting in an unpleasant sensation due to the moisture. In the case of using the technique proposed in JP '711, furthermore, fibers with a large diameter exist outside the cross section as described in Examples. As a result, prolonged treatment in a 5.0 wt % NaOH aqueous solution heated at 90° C. is necessary for complete sea removal, that is, removal (elution) of the sea component from the interior. Thus, the degradation of the remaining components cannot be ignorable. The technique proposed in JP '711 substantially makes use of fibers with large diameters (micro fibers or larger). Therefore, degradation of the remaining components is not taken into consideration. When using a nanofiber, however, it suffers an increase in specific surface area, leading to problems such as serious degradation of the remaining components, deterioration in mechanical characteristics, and coming-off of nanofiber filaments that will cause a reduction in overall quality.

For the technique given in JP '977, a proposal has been made concerning a composite yarn (combined filament yarn) composed of a polyamide fiber with a single fiber fineness of 0.3 to 10 denier (5,500 to 32,000 nm) in the core portion and a polyester fiber with a single fiber fineness of 0.5 denier (6,700 nm) or less in the sheath portion.

It is true that due to the use of a polyamide fiber as core component, the technique proposed in JP '977 is expected to serve to develop good mechanical characteristics such as preferred resilience and bending strength, as well as soft texture that is characteristic of the polyamide fiber.

The technique proposed in JP '977 substantially makes use of fibers with diameters larger than those of micro fibers. To make good use of the ductility of ultrafine fiber, therefore, it is necessary to adopt a polyamide fiber as core component and an ultrafine polyester fiber as sheath component. Accordingly, this will result in a difference in shrinkage between the core component and the sheath component, leading to bulkiness. On the other hand, as the core component having a large fiber diameter moves (shrinks) largely in the sheath component having a small fiber diameter, the technique proposed in JP '977 may also cause a variation in fabric characteristics due to an uneven distribution of ultrafine fiber filaments. Further, since the combined filament yarn is composed of different types of polymers, the compatibility between the core component and the sheath component (ultrafine fiber) is poor. Therefore, there is concern that deterioration in quality may be caused by a nap raised by friction.

Japanese Unexamined Patent Publication (Kokai) No. HEI 8-158144 examines a technique that uses a sea-island spinneret and proposes a technique relating to an spinneret designed to produce a sea-island composite fiber that contains island domains that have different cross sections (in terms of fiber diameter and cross-sectional fiber shape).

The technique proposed in JP '144 is an spinneret designed to feed a composite polymer flow containing sea component flows surrounded by an island component and unsurrounded island component flows to a confluence (compression) portion. Due to this effect, sea component flows that are not surrounded by the island component join adjacent island component flows into one island component flow. This phenomenon is caused to take place randomly to produce a combined filament yarn in which fiber threads with a large fineness and fiber threads with a small fineness coexists. To make this occur, JP '144 is characterized in not controlling the arrangement of the island domains and sea domains. The technique proposed in JP '144 is limited in controlling the fiber diameter although the size of the space between the split flows and feed holes serves to control the pressure and thereby control the rate of polymer discharge from the discharge holes. To form nano-level island domains by using the technique proposed in JP '144, the polymer feed rate per feed hole at least for the sea component should be as small as $10^{-2}$ g/min/hole to $10^{-3}$ g/min/hole. Accordingly, the pressure loss which is proportional to the polymer flow rate and wall distance and represents the major feature of JP '144, will be nearly zero, suggesting that the technique is not suitable for producing nanofibers with high accuracy. In fact, ultrafine yarns produced from the sea-island composite fibers obtained in the Examples have a fineness of about 0.07 to 0.08 d (about 2,700 nm), suggesting that they cannot serve to produce a nanofiber.

Thus, there have been strong expectations for the development of a sea-island composite fiber suitable for producing, with high quality stability and post-processability, fabrics that have good mechanical characteristics required of fabrics such as resilience and bending strength while maintaining functions (texture, function, etc.) characteristic of nanofibers after the removal of the sea component.

SUMMARY

We provide a sea-island composite fiber including two or more polymers and having a structure such that the cross section perpendicular the fiber axis contains island domains and sea domains surrounding them. The sea-island composite fiber may be used to produce, with high quality stability and post-processability, fabrics having high functions not achieved in conventional fabrics.

We further provide:

(1) A sea-island composite fiber having a cross section which contains a plurality of island components having different domain diameters, at least one of the island components having a domain diameter of 10 to 1,000 nm with a diameter variation of 1.0 to 20.0%.

(2) A sea-island composite fiber as specified in (1), wherein the differences in domain diameter among the island components are 300 to 3,000 nm.

(3) A sea-island composite fiber as specified in either (1) or (2), wherein island component A having an island diameter of 10 to 1000 nm is disposed around island component B having an island diameter of 1,000 to 4,000 nm.

(4) A sea-island composite fiber produced by removing the sea component from a sea-island composite fiber as specified in any of (1) to (3).

(5) A fiber product at least partially including a fiber as specified in any one of (1) to (4).

The sea-island composite fiber is characterized by having a cross section which contains a plurality of island components having different island domain diameters. In a fabric produced from the sea-island composite fiber by removing the sea component, the fiber with a larger fiber diameter dominates the mechanical characteristics of the fabric. As a result, the fabric has good mechanical characteristics such as resilience and bending strength, which cannot develop in fiber products formed of nanofiber. On the other hand, nanofiber is distributed uniformly without unevenness, allowing the fabric to maintain good fabric characteristics stably.

In addition, the nanofiber itself, which constitutes at least part of the fabric, has uniform quality, with an island diameter of 10 to 1,000 nm and a diameter variation of 1.0 to 20.0%. Accordingly, the gaps formed among nanofiber filaments have a uniform size and have a synergistic effect from the viewpoint of the quality stability of fabric characteristics described above.

For the sea-island composite fiber, furthermore, it is important that a plurality of island components having different fiber diameters coexist in the cross section of the sea-island composite fiber. Due to this effect, the sea-island composite fiber can be interlaced for immediate use without after-intermingling. In addition to this industrial effect, the fiber also has a very good effect from the viewpoint of preventing a variation in fabric characteristics attributable to "uneven ultrafine fiber distribution" which represents a major problem with the conventional techniques.

BRIEF DESCRIPTION OF THE DRAWINGS

FIG. 5(*a*) shows a vertical cross section of the major portion of the composite spinneret. FIG. 5(*b*) is a transverse cross section of part of a distribution plate. FIG. 5(*c*) shows a transverse cross section of a discharge plate.

EXPLANATION OF NUMERALS

Figure 1:
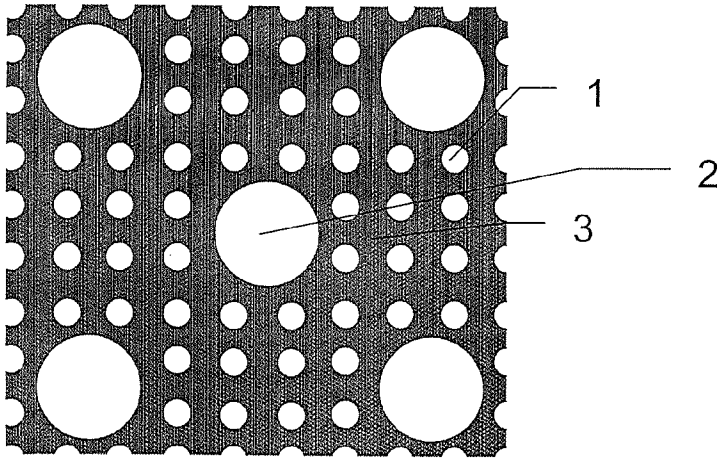
FIG. 1 is a schematic diagram of an exemplary cross section of the sea-island composite fiber.

1: island component A
2: island component B
3: sea component
4: island diameter distribution of island component A
5: island diameter peak value of island component A
6: island diameter distribution peak width of island component A
7: island diameter distribution of island component B
8: island diameter peak value of island component B
9: island diameter distribution peak width of island component A
10: island-to-island distance of island component B
11: island-to-island distance of island component A
12: measuring plate
13: distribution plate
14: discharge plate
15: measuring hole
15-(*a*): polymer A measuring hole
15-(*b*): polymer B measuring hole
16: distribution groove
16-(*a*): polymer A distribution groove
16-(*b*): polymer B distribution groove
17: distribution hole
17-(*a*): polymer A distribution hole
17-(*b*): polymer B distribution hole
17-(*c*): polymer A enlarged distribution hole
18: discharge introduction hole
19: squeezing hole
20: discharge hole
21: annular groove

DETAILED DESCRIPTION

Our fibers and methods are described in more detail below with reference to preferred examples.

A sea-island composite fiber as referred to herein includes a plurality of polymers. A sea-island (cross section) fiber as referred to herein has a structure such that island domains of a polymer are scattered in a sea domain of another polymer. The sea-island composite fiber meets the following two requirements: the first is that in a fiber (composite) cross section perpendicular to the fiber axis, at least one island component has island domain diameters of 10 to 1,000 nm, with a diameter variation of 1.0 to 20.0%, and the second is that a plurality of island components with different island domain diameters exist in a fiber cross section.

The domain diameter of an island component (island domain diameter) as referred to here is determined as follows.

Specifically, a multifilament specimen of the sea-island composite fiber is embedded in an embedding material such as epoxy resin, and its cross section is photographed by transmission electron microscopy (TEM) at a magnification at which 150 or more island component regions can be observed. If 150 or more island domains are not contained in a cross section of one composite fiber filament, a plurality of composite fiber filaments may be examined so that a total of 150 or more island domains are contained in their cross sections. In doing this, the specimen may be metal-stained to increase the contrast to make the island component clearly visible. From each photographed image of a fiber cross section, 150 island domains are selected randomly, and their diameters are measured. For a cross section of an island domain that is perpendicular to the fiber axis in a two-dimensional photographed image, the island domain diameter referred to here is defined as the diameter of the perfect circle that circumscribes the domain with the largest number of contact points (the number should be two or more). To determine the island domain diameter, it is measured in nm to the first decimal place and rounded off to the nearest whole number.

The diameter variation (variation in the island domain diameter) is calculated from measurements of the island domain diameter as follows: variation in island domain diameter (island domain diameter CV %)=(standard deviation of island domain diameter/average island domain diameter)×100(%). It is rounded off to the nearest tenth.

This procedure is performed for 10 similarly photographed images, and the island domain diameter and island domain diameter variation were determined as the simple averages over the 10 images.

For the sea-island composite fiber, island domains with a diameter of less than 10 nm may exist in a cross section, but if the island domains have a diameter of 10 nm or more, it will be easy to set up processing conditions such as for partial breakage during a spinning process and sea removal treatment.

On the other hand, to obtain a combined filament yarn having a high function not available in the conventional yarns, and to obtain a fabric made thereof, it is necessary for them to have high ductility, water absorption property, wiping-out property, and other properties characteristic of nano-level fibers. For the sea-island composite fiber, therefore, the domains of at least one island component are required to have a diameter of 1,000 nm or less. From the viewpoint of ensuring the nanofiber functions to be brought out noticeably, the domains of at least one island component are preferably have a diameter of 700 nm or less. Furthermore, taking into account the process-passing property during the post-processing step, easiness of setting up sea removal conditions, and handleability fiber products, the island domains preferably have a diameter of 100 nm or more as the lower limit. Therefore, at least one island component preferably has a domain diameter of 100 to 700 nm.

The island component having a domain diameter of 10 to 1,000 nm is required to have a diameter variation of 1.0 to 20.0%. This is because nanofibers have extremely small diameters and, accordingly, their specific surface area, that is, the surface area per unit mass, is larger than that of common fibers and micro fibers. Therefore, the functions characteristic of nanofibers are generally dependent on the specific surface area, which is in proportion to the square of the island domain diameter. This means that a large variation in the island domain diameter will lead to large variations in the characteristics of the combined filament yarns and fabrics. For these reasons, it is important for the diameter to be in the aforementioned range from the viewpoint of ensuring improved quality stability. Since nanofibers have large specific surface areas, furthermore, a solvent used for sea component removal, for instance, may have an unignorable influence on some components exposed to it even if they are sufficiently resistant to it. This technique serves to maintain uniform treatment conditions such as temperature and solvent concentration by minimizing the variation in island domain diameter. This effect works to prevent partial degradation of the island component. As a result, it has a synergistic effect from the viewpoint of ensuring improved quality stability as described above. In particular, since the sea-island composite fiber has a plurality of island components with different domain diameters, meeting the above requirements is important also from the viewpoint of simplifying the procedure for setting up conditions for post-processing including sea removal treatment.

In a combined filament yarn obtained after the removal of the sea component or in a fiber product produced from such a combined filament yarn, their characteristics such as surface characteristics are substantially dominated by the island component with a domain diameter of 10 to 1,000 nm (nanofiber) that is contained merely as one of the many components. From the viewpoint of quality stability, therefore, the variation in island domain diameter should preferable be as small as possible, for example, 1.0 to 15.0%. Furthermore, the variation in island domain diameter is more preferably 1.0 to 7.0% from the viewpoint of applying the fiber to highly dense woven fabrics that make use of the high density feature of nanofibers for providing high performance sports clothes and to high precision polishing cloth that requires high uniformity.

Figure 2:
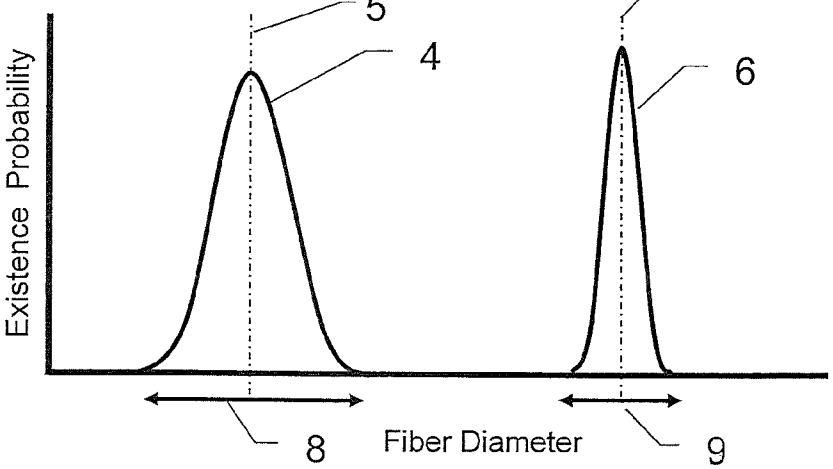
FIG. 2 is a schematic diagram of an exemplary fiber domain diameter distribution in the sea-island composite fiber.

The second requirement for the sea-island composite fiber, that is, "a plurality of island components with different domain diameters exist in a fiber cross section," is associated with the example described and explained below with reference to FIG. 1 which gives an exemplary cross section of the sea-island composite fiber. In FIG. 1, small-diameter fiber domains of island component A (indicated by 1 in FIG. 1) and large-diameter fiber domains of island component B (indicated by 2 in FIG. 1) are scattered in a sea domain. If this fiber cross section is examined by the method of evaluating the island domain diameter described above, results will show a two-peak island domain diameter distribution as given in FIG. 2 (indicated by 4 and 6 in FIG. 2). The "existence of a plurality of island components with different domain diameters in a fiber cross section" as required specifically means that observation of one (sea-island) fiber cross section show the existence of two or more peaks in the island domain diameter distribution diagram where it is assumed that a group of island domains having diameters contained in one distribution range (distribution width) belongs to one component.

The distribution width of island domain diameters (indicated by 8 and 9 in FIG. 2) referred to herein is defined as the range extending over ±30% from the peak (indicated by 5 and 7 in FIG. 2) which represents the number of island domains having the most frequently observed diameter. For each island component, the distribution width preferably extends over ±20% from the peak from the viewpoint of improvement in fiber product quality as described previously. To simplify the procedure for setting up conditions for post-processing including sea removal treatment, furthermore, the distribution width preferably extends over ±10% from the peak. In a distribution diagram for island component A and island component B, their peaks may sometimes be so close to each other to form apparently one continuous peak. From the viewpoint of preventing a difference in the state of treatment with a solvent from occurring between island domains having less frequently observed diameters and those belonging to another peak to cause coexistence of degraded island components in final fiber products, it is preferable that the island components give a discontinuous domain diameter distribution with discrete peaks.

It is important that a cross section of the composite fiber contain a plurality of island domains having different diameters as described above. This is because in the case of nanofibers (or micro fibers) produced by an after-intermingling based technique as described in JP '610, their diameter distribution diagrams have partially uneven portions at many positions when a cross section of a fabric is observed. As a result of intensive studies on this drawback, we found that the aforementioned problem with the conventional techniques can be solved by using our sea-island composite fiber. The problem can be solved because in the case of our sea-island composite fiber, the composite state of the sea-island composite fiber, specifically the position of each island domain, is maintained while the fiber is interlaced into a fabric. During the sea removal treatment step, furthermore, the fibers (island components) shrink to ensure physical restraint of the aforementioned island components. As a result, the positional relation between the fiber domains with larger diameters and those with smaller diameters will not change significantly after the removal of the sea component. Thus, the unevenness of filament distribution, which has been the problem with the conventional techniques, can be decreased largely. In a fabric having such a constitutional feature, fiber filaments with large diameters are scattered uniformly over the entire fabric. Due to this effect, fiber filaments with large diameters form the skeleton of the fabric and dominate its mechanical characteristics. Needless to say, nanofiber is disposed uniformly over the entire fabric. As a result, the fabric has ductile texture characteristic of nanofibers, denseness, water absorption property, wiping-out property, and polishing performance, spreading uniformly over the entire fabric, leading to high quality stability. In addition, uniform gaps are formed in a woven nanofiber, allowing the development of such characteristics as water retention and slow release performance.

Furthermore, elimination of the after-intermingling step has a large effect from an industrial point of view. If two types of fibers with different characteristics are intermingled in an after-intermingling step, different stresses will be applied to the fibers during the step. This is always accompanied by risks of thread breakage or the like during the intermingling step. This is because the fibers show different elongational (plastic) deformation behaviors as they are intermingled at room temperature. If heated rollers are used to depress this plastic deformation, their effect for the prevention of thread breakage will be limited because they have different softening points. Furthermore, fibers with different histories in the spinning process are intermingled, the resulting yarn will be only composed of fibers having different shrinkage rates as described in JP '610. This, combined with the aforementioned uneven distribution of fibers, commonly leads to a fabric that is partially uneven in metsuke (weight per unit surface area) particularly when the sea removal step is performed in a heated atmosphere. This sometimes results in breakage or the like of the fabric during the sea component removal treatment step. On the other hand, for our sea-island composite fiber, basically the fiber as a whole undergoes subsequent steps such as interlacing and sea component removal. In addition, there is no difference in shrinkage behavior as well because no difference exists in the history during the spinning process. This works very effectively for the resolution of the aforementioned problem, leading to largely improved smooth passage through the post-processing steps (increased post-processability).

We provide a combined filament yarn having good functions and mechanical properties characteristic of nanofibers and also provide fabrics produced from such a combined filament yarn. This requires that a plurality of island components with different domain diameters be contained in its cross section. To further enhance the effect, the difference in diameter between the island components (groups) existing in a cross section (difference in island domain diameter) is preferably 300 nm or more. This is because the fiber with larger filament diameters is expected to substantially dominate the mechanical characteristics of the fabric. For this reason, it is preferable for this fiber to be noticeably higher in rigidity than the fibers having smaller filament diameters. From this viewpoint, if attention is focused on the geometric moment of inertia as an index of the rigidity of material, the geometric moment of inertia is proportional to the fourth power of the fiber diameter. Accordingly, a difference in island domain diameter is preferably 300 nm or more because in that case, the fiber component with the larger domain diameter substantially dominate the mechanical characteristics of the fabric as compared to the fiber component with the smaller domain diameter. On the other hand, at least one island component has a nano-level diameter and, accordingly, it is preferred to take into consideration the change in the rate of treatment with different solvents that results from an increase in the specific surface area. From this viewpoint, the difference in island domain diameter is preferably 3,000 nm or less. If it is in this range, the conditions for sea component removal treatment can be set up in a simple procedure. It is also preferable because the application of an excessively large load to the island component with a large domain diameter can be avoided during the spinning process. On the basis of these considerations, the difference in island domain diameter should be as small as possible. The difference in island domain diameter is still more preferably 2,000 nm or less, and the difference in island domain diameter is particularly preferably 1,000 nm or less. It should be noted that the difference in island domain diameter referred to herein is defined as the distance between the peaks of the island components in a distribution diagram in FIG. 2 (indicated by 5 and 7 FIG. 2).

The use of the method described later serves to produce a state (in a combined filament yarn) where fiber filaments with small diameters (substantially nanofibers) are located close to fiber filaments with large diameters that is difficult to produce by the conventional methods. Such a state is preferred from the viewpoint of the uniformity of fabric characteristics as described above. In addition, a high degree of orientation of the nanofiber filaments works effectively to further enhance the texture. Furthermore, these filaments come closer to the fiber filaments with large diameters that have better mechanical characteristics to form a pseudo-entanglement state. This serves to prevent the nanofiber filaments from rupturing and coming off from the surface layer of the fabric even if a load is applied repeatedly by abrasion, etc. This is preferred therefore from the viewpoint of the durability and post-processability of the combined filament yarn or a fabric produced from the combined filament yarn. To allow the aforementioned state of a combined filament yarn to develop, it is preferable to form a sea-island cross section in which island domains with small diameters are arranged regularly around island domains with large diameters as illustrated in FIG. 1.

Furthermore, we found that an additional effect for improved color development can be brought about in a combined filament yarn and in a fabric produced from the combined filament yarn as well, in which island domains with large diameters and island domains with small diameters are arranged regularly. This is a preferred feature because it solves one of the difficult problems that takes place in applying nanofiber-based fiber products to apparel manufacturing. In particular, it has an important meaning in that such fiber products can be applied effectively to production of outer material of high performance sports clothes and apparel for women that require colorful fabrics. Specifically, nanofiber filaments have diameters in the visible light wavelength range, and light reflects diffusely on or passes through the nanofiber surface, making nanofiber-based fabrics to suffer from fading and poor color development. Accordingly, nanofibers have been used mainly for industrial material uses that do not require good color development and, in the apparel manufacturing field, they are mainly used for lining by making use of their unique texture. Compared to this, our sea-island composite fiber can provide a combined filament yarn in which fiber filaments with large diameters and fiber filaments with small diameters are in a pseudo-entanglement state as a result of a regular arrangement of island domains. Consequently, even in a case where nanofiber filaments existing in the surface layer do not contribute to color development, fiber filaments with large diameters can work to enhance color development. Thus, largely improved color development can be achieved in combined filament yarns. This appears as a clear difference in fabrics made therefrom, demonstrating that the regular arrangement of fiber filaments with large diameters and fiber filaments with small diameters can work effectively to ensure good color development. In the sea-island composite fiber, furthermore, the nanofiber filaments existing around the fiber filaments with large diameters have highly uniform cross sections, and it is expected that the pseudo-porous structures in the interlaced nanofiber filaments are making contributions to the improvement in color development. This feature is achieved only in our sea-island composite fiber, while fabrics with uneven fiber distribution produced by the conventional methods suffer from the problem of uneven color development that may cause longitudinal streaks. To obtain a combined filament yarn, and a fabric produced from the combined filament yarn as well, that achieve both good color development and functions characteristic of nanofibers, it is preferable that domains of island component A with diameters of 10 to 1,000 nm are arranged around those of island component B with diameters of with diameters of 1,000 to 4,000 nm. Taking into consideration the compatibility between island component A and island component B during the sea component removal step and the simplification in setting up sea component removal conditions, it is more preferable for island component B to have a diameter of 1.500 to 3,000 nm. In the state in which island component A is arranged around island component B as described herein, domains of island component B are not located adjacent to each other and, when viewed from the center of each domain of island component B, domains of island component A are arranged regularly through the whole 360° as illustrated in FIG. 1.

In view of the uniformity of the combined filament yarns produced from the sea-island composite fiber, it is preferable that the domains of the island components are preferably fixed (restrained) uniformly, and the evenness of the sea domain (distances among the island domains) is also an important factor. In this respect, it is preferable that island domains having nearly the same diameter be located at regular intervals in the fiber cross section, and more specifically, the variation in the island-to-island distance, that is, the distance between the centers of adjacent island domains with the same diameter (indicated by 10 in FIGS. 3 and 11 in FIG. 4), is preferably 1.0 to 20.0%.

To determine the variation in the island-to-island distance referred to herein, the cross section is two-dimensionally photographed by the same procedure as that used for the island domain diameters and the variation in the island domain diameter described above. From this image, the length of the straight line between the centers of adjacent island domains with the same diameter is measured as shown by 10 in FIG. 3. The length of this straight line, which is assumed to represent the distance between the island domains, was measured for randomly selected 100 pairs of such domains, and the variation in the distance between island domains (CV % of island-to-island distance) was determined from the average and standard deviation of the island-to-island distance. When 100 or more island-to-island distances were not observable in one composite fiber cross section, many composite fiber cross sections were photographed to obtain 100 island-to-island distances. The variation in island-to-island distance is calculated as (standard deviation of island-to-island distance/average island-to-island distance)×100(%). It is rounded off to the nearest tenth. As in the case of the aforementioned evaluation of cross sections, this procedure is performed for 10 photographed images, and the variation in island-to-island distance was determined as the simple average over the 10 images.

To ensure improved color development in a combined filament yarn produced from the sea-island composite fiber or in fabrics produced from the combined filament yarn, the aforementioned variation in the island-to-island distance should preferably small, and it is more preferably 1.0 to 10.0%.

A post-process is actually required to use the sea-island composite fiber as a fiber product and, in view of the processability in the post-process, it is preferable for the fiber to have a certain level of ductility and specifically, the strength and elongation are preferably 0.5 to 10.0 cN/dtex and 5 to 700%, respectively. The strength referred to herein is determined by measuring the load-stretch curve of a multifilament under the conditions specified in JIS L1013 (1999) and dividing the load at rupture by the initial fineness, and the elongation is determined by dividing the elongation at rupture by the initial specimen length. The initial fineness is calculated from the fiber diameter determined, number of filaments, and density, or determined by measuring the weight of a length of fiber for a plurality of specimens and calculating the weight per 10,000 m from their simple average. To resist the processing in the post-processing step and practical use, the sea-island composite fiber preferably has a strength of 0.5 cN/dtex or more and practically 10.0 cN/dtex or less. The elongation is preferably 5% or more and practically 700% or less in view of the processability in the post-processing step. The strength and elongation may be adjusted appropriately by controlling the conditions for the production step, depending on the intended uses.

When a combined filament yarn produced from the sea-island composite fiber is used for production of general clothes such as undershirt and overgarment, it preferably has a strength of 1.0 to 4.0 cN/dtex and elongation of 20 to 40%. For use as clothes such as sportswear to be used in a severe environment, the strength and elongation are preferably 3.0 to 5.0 cN/dtex and 10 to 40%, respectively.

When used as industrial materials such as wiping cloth and polishing cloth, the fiber will be used to rub the surface of an object while being pulled under a load. Accordingly, the strength and elongation are preferably 1.0 cN/dtex or more and 10% or more, respectively, to prevent breakage and coming-off of combined filament yarns during, for example, wiping operation.

The sea-island composite fiber may be in the form of various intermediates such as winding-up fiber package, tow, cut fiber, floccus, fiber ball, cord, pile, textiles and knitted fabrics, and nonwoven fabrics, which may be processed by sea component removal or other treatments to produce combined filament yarns for manufacture of various fiber products. Furthermore, the sea-island composite fiber may be provided as fiber products in the untreated form or after undergoing partial sea component removal or island component removal treatment. The fiber products referred to herein include jackets, skirt, pants, underwear, other general clothes, sports clothes, clothing material, carpets, sofas, curtains, other interior products, car seats, other vehicle interior finishing material, cosmetics, cosmetic masks, wiping cloth, fitness gear, other livingware, polishing cloth, filters, harmful substance remover products, battery separators, other environmental/industrial material, surgical suture, scaffold, artificial vessels, blood filters, and other medical products.

An exemplary production method for the sea-island composite fiber is described below.

The sea-island composite fiber can be produced by processing a sea-island composite fiber formed of a plurality of polymers. To produce a sea-island composite fiber yarn, it is preferable to perform sea-island multicomponent fiber spinning from melts from the viewpoint of increasing the productivity. Needless to say, solution spinning may also be performed to produce the sea-island composite fiber. When carrying out sea-island multicomponent fiber spinning to produce a yarn, the use of a sea-island composite spinneret is preferable because it serves effectively to control the fiber diameter and cross-sectional shape.

It is extremely difficult to produce the sea-island composite fiber by using a generally known conventional pipe type sea-island composite spinneret, from the viewpoint of controlling the cross-sectional shape of the island domains. This is because successful implementation of the sea-island component fiber spinning would require controlling a minimal polymer flow rate of $10^{-1}$ g/min/hole to $10^{-5}$ g/min/hole, which is smaller by several orders of magnitude that used in conventional methods, and it is preferred to use a sea-island composite spinneret as illustrated in FIG. 5.

Figure 5:
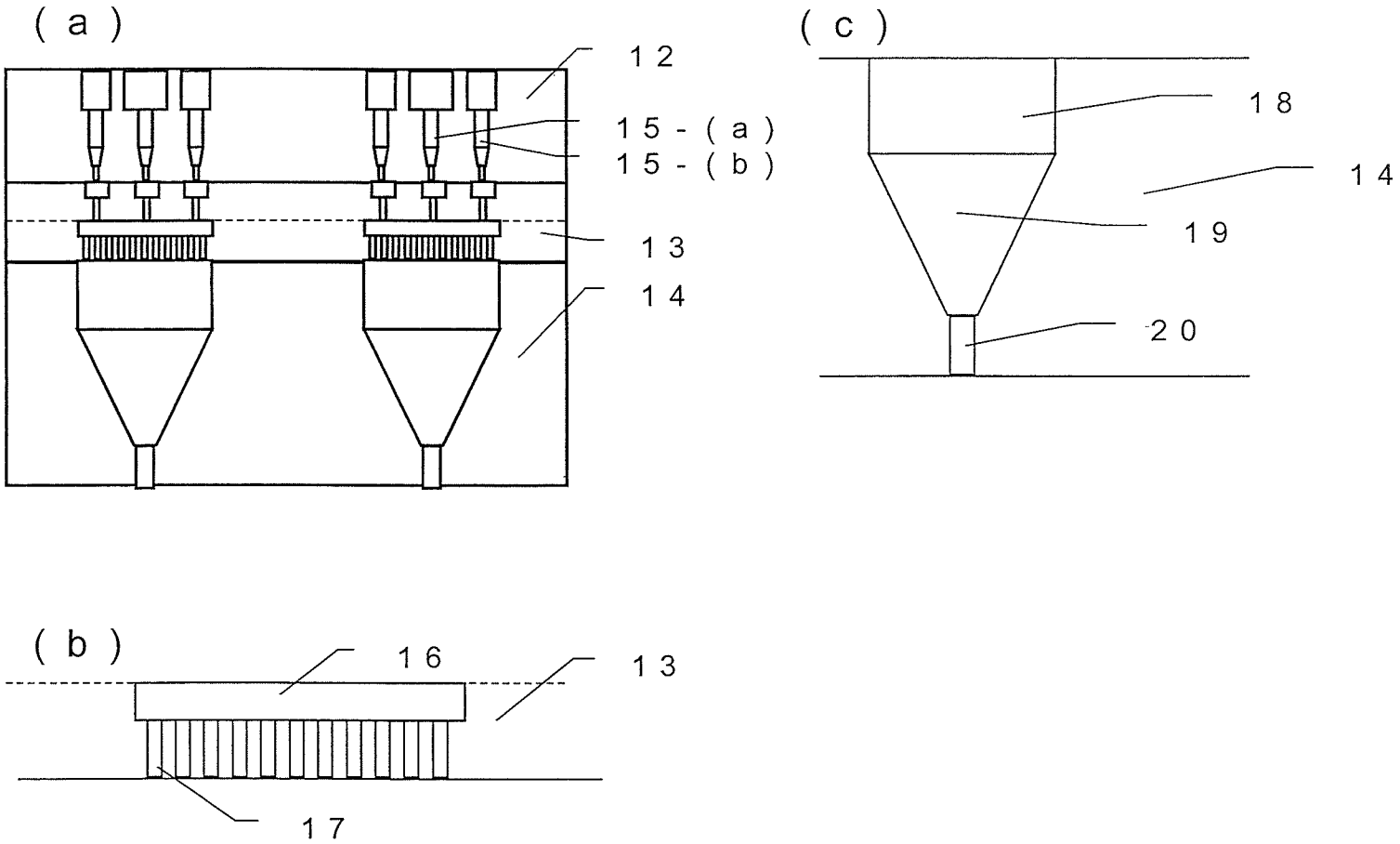
FIG. 5 is a trio of explanatory diagrams showing the production method for the ultrafine fiber, focusing on the shape of the composite spinneret.

The composite spinneret given in FIG. 5 is composed mainly of the three members of measuring plate 12, distribution plate 13, and discharge plate 14, from top to bottom, to constitute a layered structure which is built into a spinning pack to be used for spinning FIG. 5 shows an example in which two polymers, that is, polymer A (island component) and polymer B (sea component), are used. In the case where a combined filament yarn formed of the island component is to be produced by removing the sea component from the sea-island composite fiber, a low solubility polymer and a high solubility polymer may be used as the island component and sea component, respectively. If necessary, a yarn may be produced by spinning three or more polymers including others than the aforementioned low solubility component and high solubility component. This is because the use of low solubility polymers with different characteristics as island components serves to produce a combined filament yarn having characteristics that cannot achieved by using a single polymer. Such a composite yarn composed of three or more polymers is difficult to produce by use of the conventional pipe type composite spinneret, and it is preferable to use a composite spinneret containing fine flow channels as illustrated in FIG. 5.

In regard to the spinneret members illustrated in FIG. 5, the measuring plate 12 feeds polymers while measuring the polymer feeding rates for each discharge hole 20 and distribution hole for the sea and island components, and the distribution plate 13 controls the shapes of the sea-island composite cross section and the island component cross sections in the cross section of the single (sea-island composite) fiber. Then the discharge plate 14 compresses and discharges the composite polymer flow formed by the distribution plate 13. To avoid complexity in explanation of the composite spinneret, the members overlying the measuring plate are not shown in the figure, but any appropriate ones may be used if they have flow channels suitable for the spinning machine and spinning pack. For example, a conventional spinning pack and its members may serve effectively without any modifications if the measuring plate is tailored to the existing flow channel members. It is not necessary, therefore, to prepare a specially designed spinning machine to be used with this composite spinneret. In actual cases, furthermore, a plurality of flow channel plates (not shown in the figure) may be provided between the flow channels and the measuring plate and between the measuring plate 13 and the distribution plate 14. This intends to provide flow channels that work to allow the polymers to be efficiently transferred in the cross-sectional direction of the spinneret and the cross-sectional direction of the single fiber to ensure smooth introduction to the distribution plate 14. The composite polymer flow is discharged through the discharge plate 14 and subjected to conventional melt spinning, cooling for solidification, and lubrication, followed by taking up on a roller with a prescribed circumferential speed to provide a sea-island composite fiber.

An exemplary composite spinneret is described below in more detail with reference to drawings (FIGS. 4 to 7).

Figure 4:
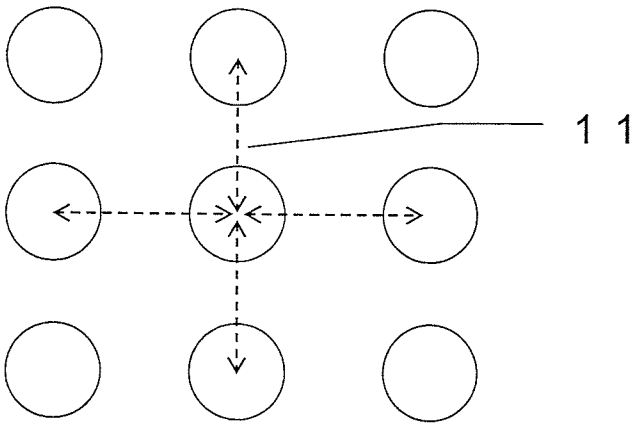
FIG. 4 is an explanatory diagram showing distances among island domains (enlarged view of the portion defined by broken lines in FIG. 3).
Figure 6:
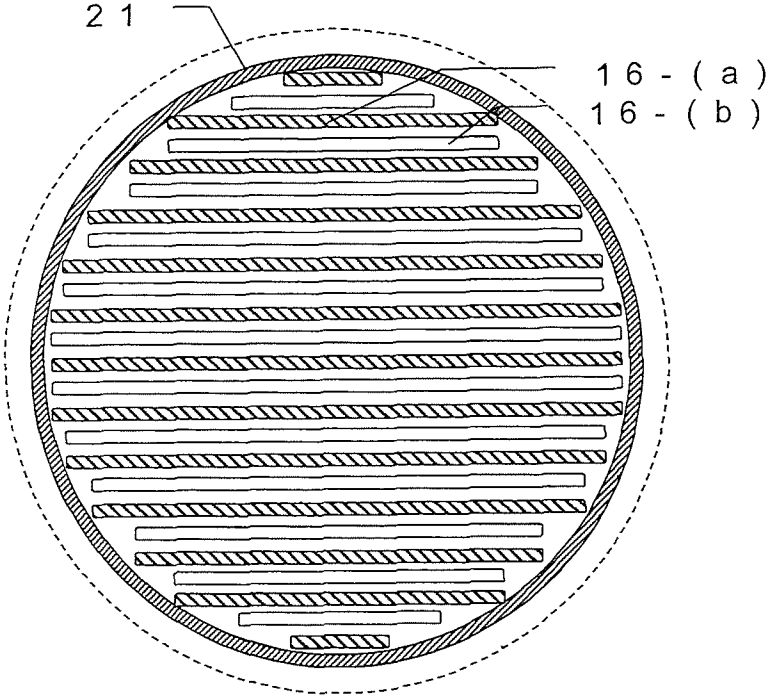
FIG. 6 is an example of part of the discharge plate.
Figure 7:
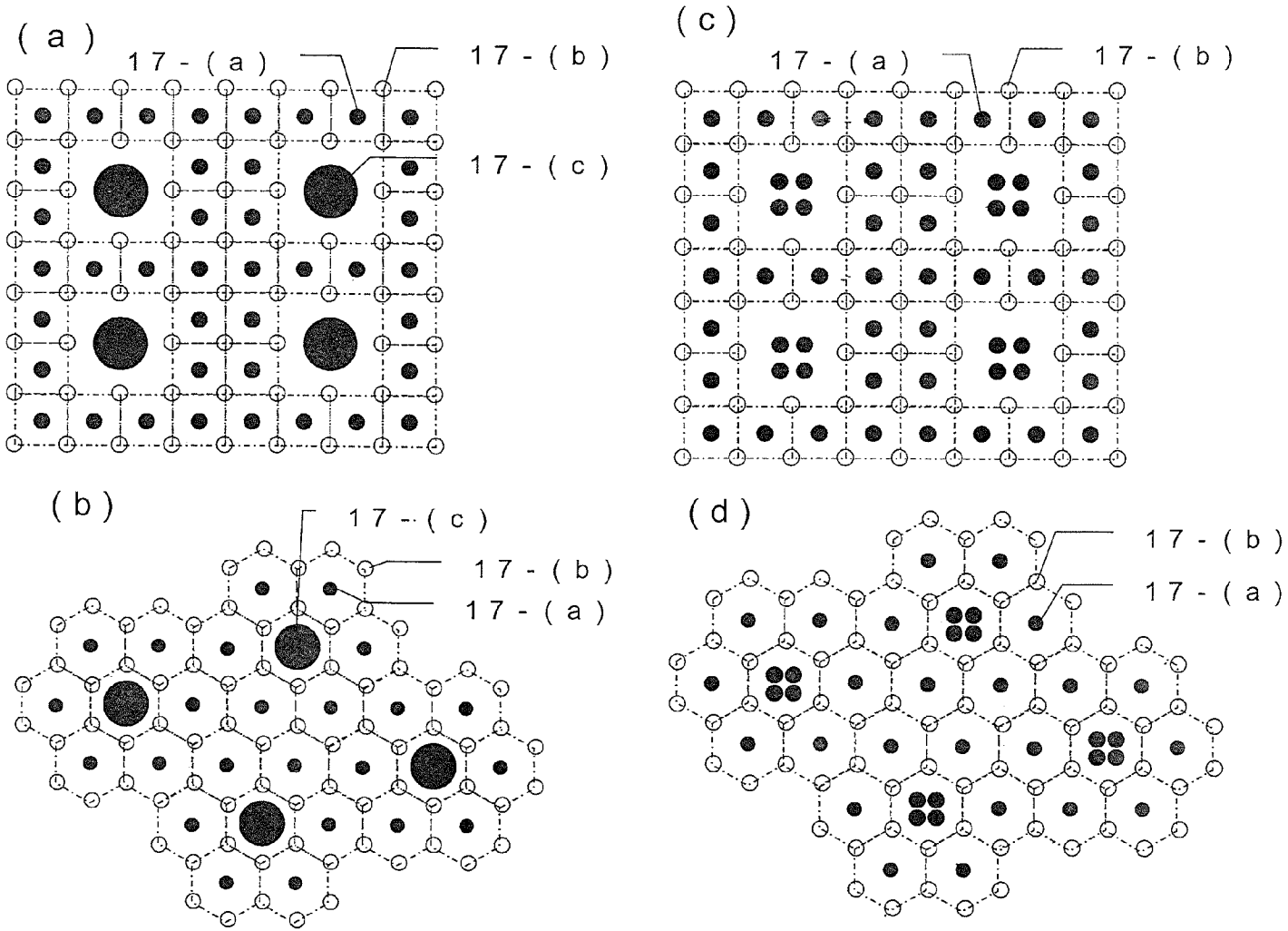
FIG. 7 is an example of distribution hole arrangement in a final distribution plate and FIGS. 7(*a*) to 7(*d*) each show an enlarged view of part of the final distribution plate.

FIGS. 4(*a*) to (*c*) are explanatory diagrams schematically illustrating an exemplary sea-island composite spinneret. FIG. 4(*a*) shows a front vertical section of major portions that constitute the sea-island composite spinneret, and FIGS. 4(*b*) and 4(*c*) give a cross-sectional view of part of the distribution plate and a cross-sectional view of part of the discharge plate, respectively. FIG. 5 shows a front vertical section of part of the discharge plate and FIG. 6 is a plan view of the distribution plate. FIGS. 7(*a*) to 7(*d*) give enlarged views of part of the distribution plate, each having grooves and holes for each discharge hole.

Described below is the process, from upstream to downstream, in which the feed materials move through the measuring plate and distribution plate in the composite spinneret illustrated in FIG. 4 to form a composite polymer flow, which is then discharged through the discharge holes of the discharge plate.

Polymer A and polymer B, supplied from upstream of the spinning pack, flow into the measuring hole 15-(*a*) for polymer A and the measuring hole 15-(*b*) for polymer B, respectively, in the measuring plate and then flow into the distribution plate 13 after being measured by aperture diaphragms provided at the bottom. The weighing of polymer A and polymer B is performed on the basis of the pressure loss caused by the aperture in each measuring hole. This aperture is designed so that the pressure loss is 0.1 MPa or more. On the other hand, it is preferably designed so that the pressure loss is 30.0 MPa or less to prevent the members from being deformed by an excessive pressure loss. The pressure loss is determined on the basis of the inflow rate and viscosity of the polymer supplied to each measuring hole.

For example, accurate weighing and smooth discharge take place when the aperture of the measuring hole has a diameter of 0.01 to 1.00 mm and a ratio L/D (discharge hole length/discharge hole diameter) of 0.1 to 5.0 in the case where a polymer having a viscosity of 100 to 200 Pa·s at a temperature of 280° C. and a strain rate of 1000 $s^{-1}$ is melt-spun under the conditions of a spinning temperature of 280 to 290° C. and a through-put rate of 0.1 to 5.0 g/min for each measuring hole. In cases where the melt viscosity of the polymer is below the aforementioned viscosity range or where the rate of discharge from each hole is smaller, the hole diameter may be reduced so that it becomes close to the lower limit of the aforementioned range or the hole length is increased so that it becomes close to the upper limit of the aforementioned range. On the contrary, if the viscosity is too large or the through-put rate is too high, the hole diameter and hole length may be changed in the opposite manners. It is preferable furthermore that a plurality of measuring plates 12 are stacked to weigh the polymers in several stages. It is preferable to provide measuring holes in 2 to 10 stages. The use of a plurality of measuring plates or the use of measuring holes in a plurality of stages is preferable for controlling a minimal polymer flow rate of $10^{-1}$ g/min/hole to $10^{-5}$ g/min/hole, which is smaller by several orders of magnitude that used in the conventional methods. From the viewpoint of prevention of the pressure loss per spinning pack from becoming excessively large and reduction of the possibility of an excessive residence time and abnormal residence, it is particularly preferable to use 2 to 5 stages of measuring plates.

The polymers fed through each measuring hole 15 (15-(*a*) and 15-(*b*) in FIG. 4) flow into the distribution grooves 16 in the distribution plate 13. To improve stability of the sea-island composite cross section, it is preferable that the same number of grooves as that of the measuring holes 15 be provided between the measuring plate 12 and the distribution plate 13, and that the grooves be directed toward the cross-sectional direction as they extend downstream to form flow channels, so that the flows of polymer A and polymer B are enlarged in the cross-sectional direction before flowing into the distribution plate. Again, it is preferable to provide a measuring hole for each of the flow channels.

The distribution plate contains distribution grooves 16 (16-(*a*) and 16-(*b*)) that receive the polymers incoming from the measuring holes 15 and distribution holes 17 (17-(*a*), 17-(*b*) and 17-(*c*)), provided below the distribution grooves, to send the polymers downstream. It is preferable for each distribution groove 16 to have a plurality of distribution holes. It is also preferable to use a plurality of distribution plates 13 so that confluence and distribution of each polymer separately take place repeatedly in some parts of the plates. If flow channels are designed so that the flow moves repeatedly through a path including a plurality of distribution holes, distribution groove, and a plurality of distribution holes, the polymer flow can move through any of normal distribution holes even if some distribution holes are blocked. Thus, even if a distribution hole is blocked, the lost portion is filled in a downstream distribution groove. Furthermore, a plurality of distribution holes are provided for each distribution groove and this is repeated, thereby substantially eliminating the influence of the blocking of a distribution hole and the inflow of the polymer into another distribution hole.

In addition, these distribution grooves have large effects in that polymer flows that have passed through several channels and have different heat histories undergo confluence several times, leading to a decrease in the variation in viscosity. If they are to be designed so that the flows pass through distribution holes, distribution groove, and distribution holes repeatedly, it is preferable that downstream distribution grooves are shifted by an angle 1 to 179° in the circumferential direction from the upstream distribution grooves to form a structure in which polymer flows coming from different distribution grooves are combined, leading to several times of confluence of polymer flows with different heat histories, which serves effectively for control of the sea-island composite cross section. From the viewpoint of the aforementioned objective, this mechanism of confluence and distribution is preferably provided in upstream portions including measuring plates and members located upstream therefrom. In regard to the distribution holes described above, it is preferable to provide a plurality of holes for each distribution groove to ensure efficient division of polymer flows. In regard to the distribution plate located immediately before the discharge holes, furthermore, it is preferable that about 2 to 4 distribution holes be provided for each distribution groove from the viewpoint of the simplification of spinneret design and the control of minimal polymer flow rates.

A composite spinneret of this structure ensures constant, stable polymer flows as described above, and makes it possible to produce a sea-island composite fiber containing an extremely large number of high-accuracy island domains necessary. The number of distribution holes 17-(*a*) and 17-(*c*) (number of island domains) of polymer A may be theoretically from one to as large as possible if a required space is available. As a substantially practical range, the total number of island domains is preferably 2 to 10,000. To reasonably meet the requirements for the sea-island composite fiber, the total number of island domains is more preferably 100 to 10,000, and the density of island domains is practically 0.1 to 20.0 islands/mm$^2$. This density of island domains is preferably 1.0 to 20.0 island/mm$^2$. The density of island domains as referred to here represents the number of island domains per unit area, and a larger density means the possibility of producing a sea-island composite fiber containing a larger number of island domains. The density of island domains as referred to here is calculated by dividing the number of island domains discharged from one discharge hole by the area of the discharge introduction hole. This density of island domains may vary among different discharge holes.

The cross-sectional structure of the composite fiber and the cross-sectional shape of the island domains can be controlled by changing the arrangement of the distribution holes 17 for polymer A and polymer B provided in the distribution plate 13 immediately above the discharge plate 14. Specifically, composite polymer flows that serve to produce the sea-island composite fiber can be formed by using an arrangement as illustrated in FIGS. 7-(*a*) to 7-(*d*) that show distribution holes 17-(*a*) for polymer A and distribution holes 17-(*b*) for polymer B.

In FIG. 7-(*a*), distribution holes 17-(*a*) for polymer A and distribution holes 17-(*b*) for polymer B are arranged in a square lattice and only some distribution holes for polymer A located at regular intervals have larger diameters. A distribution plate in a composite spinneret contains fine flow channels, and in principle, the through-put rate from a distribution hole is controlled based on the pressure loss in the distribution hole 17. Furthermore, the measuring plate is working to control the inflow rates of polymer A and polymer B uniformly, allowing uniform pressures to be maintained in the fine flow channels provided in the distribution plates. Accordingly, as seen in FIG. 7-(*a*), for example, if there are distribution holes 17-(*c*) with larger hole diameters in some portions, the through-put rates of the enlarged distribution holes 17-(*c*) automatically increase as compared to those of distribution holes 17-(*a*) to compensate the pressure loss in the portions (to achieve uniformity). This is the principle for forming island domains that are controlled highly accurately in spite of changes in diameter, and if this principle is maintained, the distribution holes 17-(*b*) for polymer B are required only to be arranged regularly while avoiding fusion of adjacent island domains as illustrated in FIG. 7-(*a*). This principle holds also in cases where the holes are arranged in a hexagonal lattice as illustrated in FIG. 7-(*b*). Described above are some examples of distribution hole arrangement in a polygonal lattice, but as another example, distribution holes may be arranged along concentric circles with one hole at the center. An optimum hole arrangement may be set up in consideration of the combination of the polymers selected as described later, but in view of the diversity of the combinations of polymers, distribution holes are preferably arranged in a rectangular or higher-order polygonal lattice. Another method for producing island domains with enlarged diameters without utilizing enlarged distribution holes is, as illustrated in FIG. 7-(*c*) and FIG. 7-(*d*), to first form a plurality of distribution holes 17-(*a*) for polymer A at mutually close positions and discharging the polymer A component through the distribution holes to cause fusion between polymer A flows through the Barus effect. From the viewpoint of simplicity of spinneret design, this method is preferable because all the distribution holes have the same diameter, leading to easy prediction of the pressure loss.

To achieve the cross-sectional feature of the sea-island composite fiber, it is preferable to control the viscosity ratio between polymer A and polymer B (polymer A/polymer B) at 0.1 to 20.0, in addition to the aforementioned arrangement of the distribution holes. Although the degree of domain enlargement of the island component is basically controlled by the arrangement of the distribution holes, the squeezing holes 19 in the discharge plate work to combine the flows and squeeze them in the cross-sectional direction and accordingly, the ratio in the melt viscosity between polymer A and polymer B, that is, the ratio in rigidity during the melting step, influences the formation of their cross sections. Thus, the ratio of polymer A/polymer B is more preferably in the range of 0.5 to 10.0. The melt viscosity referred to herein is determined using a chip-like polymer specimen dried in a vacuum dryer to a moisture content of 200 ppm or less and making measurements in a nitrogen atmosphere by use of a melt viscosity measuring apparatus whose strain speed can be changed in stages. The melt viscosity was measured at the same temperature as the spinning temperature and the melt viscosity measurement made at a strain speed of 1,216 $s^{-1}$ was taken as the melt viscosity of the polymer. The ratio in melt viscosity was determined by separately measuring the melt viscosity of each polymer component and the ratio of the viscosity of polymer A to that of polymer B was calculated and rounded off to the nearest tenth.

When performing the sea-island composite fiber production method, basically polymer A and polymer B have different compositions and accordingly have different melting points and heat resistance features. Ideally, therefore, it is desirable to adjust the melting temperature of each polymer before spinning, but a special spinning apparatus will be required to separately control the melting temperature of each polymer. In general, therefore, spinning is performed at a certain fixed spinning temperature, and in view of the simplicity in setting up the spinning conditions (temperature, etc.), it is particularly preferable to control the polymer A/polymer B ratio in the range of 0.5 to 5.0. In regard to the melt viscosity of the aforementioned polymer components, their melt viscosities can be separately controlled relatively flexibly, even if they are of the same species, by adjusting their molecular weights and selecting suitable copolymerization components and the melt viscosity is used as an index of polymer combination and spinning conditions.

The composite polymer flow composed of polymer A and polymer B discharged from the distribution plate flows into the discharge plate 14 through the discharge introduction holes 18. The discharge plate 14 preferably has discharge introduction holes 18. A discharge introduction hole 18 serves to carry the composite polymer flow discharged from the distribution plate 13 over a certain distance perpendicular to the discharge surface. This is intended to reduce the difference in flow rate between polymer A and polymer B and also uniformize the cross-sectional distribution of the flow rate of the composite polymer flow. For the uniformization of the flow rate distribution, it is preferable to control the flow rate of each polymer flow by optimizing the through-put rate, diameter, and number of the distribution holes 17 (17-(*a*), 17-(*b*), and 17-(*c*)). However, if this is incorporated into spinneret design, the number of islands, etc. will be sometimes limited by the design. Therefore, although the polymer molecular weight has to be taken into consideration, it is preferable from the viewpoint of substantial completion of the reduction in the difference in flow rate ratio, that the discharge introduction holes be designed to allow the composite polymer flow to take $10^{-1}$ to 10 seconds (=length of discharge introduction hole/polymer flow rate) before being introduced into the squeezing holes 19. If the time is in this range, the flow rate distribution is sufficiently uniformized to effectively ensure improved stability of the cross section.

Then, before being introduced into the discharge holes with intended diameters, the composite polymer flow passes through the squeezing holes 19 where the polymer flow is squeezed in the cross-sectional direction. The central streamline through the composite polymer flow extends nearly straight, but streamlines located closer to the surface are curved significantly. To obtain the sea-island composite fiber, it is preferable that a bundle of an indefinitely large number of polymer flows of polymer A and polymer B is squeezed while maintaining its cross-sectional features. Accordingly, the wall of the squeezing hole 19 is set to an angle of 30° to 90° to the discharge surface.

From the viewpoint of maintaining the cross-sectional feature in the squeezing hole 19, it is preferable to produce an outermost sea layer at the surface of the composite polymer flow by, for example, providing an annular groove 21 containing distribution holes at the bottom face as illustrated in FIG. 6, which is formed in the distribution plate located immediately above the discharge plate. This is because the composite polymer flow discharged from the distribution plate is squeezed largely by the squeezing hole in the cross-sectional direction. During this process, the polymer in the outermost layer composite polymer flow undergoes a shear strain caused by the hole wall in addition to being curved. Looking more closely at the contact between the hole wall and the surface of the polymer flow, the flow rate of is lower due to the shear stress at the contact surface with the hole wall while the flow rate is higher in inner portions, possibly resulting in a skewed flow rate distribution. Thus, the aforementioned shear stress caused by the hole wall will be borne by the sea component (B polymer) layer at the surface of the composite polymer flow, leading to stabilization of the flow of the composite polymer, particularly the flow of the island component. This brings a largely improved fiber diameter and fiber shape of the island component (polymer A). If an annular groove 21 as illustrated in FIG. 6 is used to form an outermost layer of the sea component (polymer B) in the composite polymer flow, the distribution holes to be formed at the bottom face of the annular groove 21 are preferably designed while talking into consideration the number of distribution grooves in the distribution plate and the through-put rate. In typical cases, it may be practical to provide one hole in every 3°, preferably one hole in every 1°, in the circumferential direction. To feed the polymer into the annular groove 21, the distribution grooves 10 for the sea component polymer in the distribution plate located on the upstream side may be extended in the cross-sectional direction with distribution holes provided at both ends, which will serve to allow the polymer to easily flow into the annular groove 21. A distribution plate having one annular groove 21 is shown in FIG. 6 as an example, but it may have two or more annular grooves, and different polymer components may flow through these annular grooves.

The composite polymer flow formed in the distribution plate 13 is discharged from the discharge holes 20 along the spinning line while maintaining the cross-sectional feature reflecting the arrangement of the distribution holes 17 (17-(*a*) and 17-(*b*)). The discharge holes 20 are designed to re-measure the flow rate, i.e., the through-put rate, of the composite polymer flow and control the draft ratio (=take up speed/discharge line speed) along the spinning line. Preferably, an optimum diameter and length of the discharge holes 20 are determined taking into consideration the viscosity and the through-put rate of the polymer. For the production of the sea-island composite fiber, the discharge hole diameter may be 0.1 to 2.0 mm and the L/D (discharge hole length/discharge hole size) may be 0.1 to 5.0.

The sea-island composite fiber can be produced by using a composite spinneret as described above. Its use to carry out melt spinning is preferred from the viewpoint of productivity and simplicity of equipment, but needless to say, this composite spinneret also serves to produce the sea-island composite fiber by a solvent-based spinning method such as solution spinning.

When melt spinning is to be performed, the polymers that can be used as the island and sea components include, for example, melt-moldable ones such as polyethylene terephthalate, copolymers thereof, polyethylene naphthalate, polybutylene terephthalate, polytrimethylene terephthalate, polypropylene, polyolefin, polycarbonate, polyacrylate, polyamide, polylactic acid, and thermoplasticity polyurethane. In particular, condensation-polymerized polymers such as polyester and polyamide are more preferable because of their high melting points. From the viewpoint of high heat resistance, the polymers to be used preferably have a melting point of 165° C. or more. In addition, the polymers may contain inorganic substances such as titanium oxide, silica, and barium oxide, coloring agents such as carbon black and other dyes and pigments, and other various additives such as flame retardant, fluorescent brightening agent, antioxidant, and ultraviolet absorber. If a sea removal or island removal treatment is to be performed, it may be practical to use polymers that are melt-moldable and higher in solubility than the other components such as polyester and copolymers thereof, polylactic acid, polyamide, polystyrene and copolymers thereof, polyethylene, and polyvinyl alcohol. As such a high-solubility component, it is preferable to use copolymerized polyester, polylactic acid, and polyvinyl alcohol that are highly soluble in aqueous solvents and hot water, and in particular, polyethylene glycol and sodium sulfoisophthalic acid, used singly, as well as polyester and polylactic acid produced through copolymerization thereof, are preferable from the viewpoint of high spinnability and high solubility in low-concentration aqueous solvents. Furthermore, polyester produced through copolymerization with sodium sulfoisophthalic acid alone is particularly preferable from the viewpoint of the easiness of sea removal and fiber openability of the resulting ultrafine fibers.

To identify an appropriate combination of a low-solubility component and a high-solubility component as described above, it is practical to select an appropriate low-solubility component suitable for the intended use and then select an appropriate high-solubility component that can be spun at the same spinning temperature, on the basis of the melting point of the low-solubility component. From the viewpoint of improvement of uniformity in terms of the fiber diameter and cross-sectional shape of the island component of the sea-island composite fiber, it is preferable to appropriately adjust the molecular weight, etc. of each component taking into consideration the melt viscosity ratio as described above. When a combined filament yarn is to be produced from the sea-island composite fiber, furthermore, the difference between the low-solubility component and the high-solubility component in the rate of dissolution in the solvent used for sea removal should be as large as possible from the viewpoint of ensuring the stability of the cross-sectional shape of the combined filament yarn and maintaining its mechanical characteristics, and an appropriate combination among the aforementioned polymers with a dissolution rate ratio of up to about 3,000 should preferably be identified. From the viewpoint of their melting points, preferred polymer combinations for obtaining a combined filament yarn from the sea-island composite fiber include the use of polyethylene terephthalate copolymerized with 1 to 10 mol % of 5-sodium sulfoisophthalic acid as sea component with polyethylene terephthalate or polyethylene naphthalate as island component and the use of polylactic acid as sea component with nylon 6, polytrimethylene terephthalate, or polybutylene terephthalate as island component.

When spinning a sea-island composite fiber to be used, the spinning temperature should be such that of the plurality of polymers, the one mainly with the highest melting point or highest viscosity shows flowability. Depending on the molecular weight, the temperature where the polymer shows flowability reflects its melting point, and may be set up to 60° C. above the melting point. Such a temperature is preferable because the decrease in molecular weight can be depressed without suffering from heat decomposition of the polymer in the spinning head or spinning pack.

To ensure stable discharge, the through-put rate for spinning of a sea-island composite fiber to be used may be 0.1 g/min/hole to 20.0 g/min/hole for each discharge hole 20. For this step, it is preferable to take into consideration the pressure loss in the discharge hole to ensure stability of the discharge. The pressure loss referred to here is commonly 0.1 MPa to 40 MPa, and an appropriate through-put rate should preferably be identified taking into consideration this range as well as the melt viscosity of the polymer, discharge hole diameter, and discharge hole length.

For the spinning of a sea-island composite fiber to be used, the ratio between the low-solubility component and the high-solubility component can be set at 5/95 to 95/5 as the sea-island ratio in terms of the through-put rate. In regard to this sea-island ratio, the productivity for the production of a combined filament yarn increases with an increasing proportion of the island. From the viewpoint of the long term stability of the cross section of the sea-island composite, this sea-island ratio is more preferably 10/90 to 50/50 to ensure efficient and stable production of the ultrafine fiber, and it is particularly preferably 10/90 to 30/70 from the viewpoint of quick completion of the sea removal treatment and improved operability of the ultrafine fiber.

The sea-island composite polymer flow thus discharged forms a sea-island composite fiber after being cooled for solidification, treated with an oil solution, and taken up on a roller with a prescribed circumferential speed. An appropriate take-up speed may be set on the basis of the through-put rate and intended fiber diameter, but it is preferably 100 to 7,000 m/min to ensure stable production of a sea-island composite fiber to be used. To ensure a high degree of orientation and improved mechanical characteristics, the sea-island composite fiber may be drawn after being winding up or drawn in a continued step without being winding up.

With respect to the conditions for this drawing, a drawing machine with one or more pairs of rollers, for example, are used commonly for a fiber of a melt-spinnable, thermoplastic polymer. Such a polymer can be drawn smoothly between a first roller controlled at a temperature above the glass transition point and below the melting point and a second roller controlled nearly at the crystallization temperature, which have an appropriate circumferential speed ratio, followed by heat-setting and winding-up to provide the sea-island composite fiber. In the case of a polymer that does not show glass transition, the dynamic viscoelasticity of the sea-island composite fiber (tan δ) is measured, and it will be practical to perform preliminary heating at a temperature higher than the temperature of the high-temperature side peak of tan δ. It is preferred to carry out this drawing in multiple stages to increase the draw ratio and improve the mechanical properties.

To produce a combined filament yarn from the sea-island composite fiber thus obtained, the high-solubility component is removed by immersing the composite fiber in a solvent that can dissolve the high-solubility component, thereby providing an ultrafine fiber composed of the low-solubility component. When the easily dissolvable component is a copolymerized PET, polylactic acid (PLA), etc., copolymerized with 5-sodium sulfoisophthalic acid, etc., an aqueous alkali solution such as aqueous sodium hydroxide solution can be used. As a method for the treatment of the composite fiber with an aqueous alkali solution, for example, the composite fiber or a fiber structure formed thereof may be immersed in an aqueous alkali solution. Heating of the aqueous alkali solution at 50° C. or more is preferable because the hydrolysis can be accelerated. Furthermore, the use of a fluid dyeing machine, etc. for the treatment is preferable from an industrial viewpoint because a large batch can be processed at a time to achieve a high productivity.

Thus, production of the ultrafine fiber is described above on the basis of a common melt spinning technique, but needless to say, meltblowing and spunbonding can be used for its production, and furthermore a wet or a dry-wet solution spinning technique can also serve for its production.

EXAMPLES

The ultrafine fiber will now be illustrated in greater detail with reference to Examples.

For Examples and Comparative Examples, evaluations were made as described below.

A. Melt Viscosity of Polymers

Chips of a polymer were dried in a vacuum dryer down to a moisture content of 200 ppm or less, and subjected to melt viscosity measurement in Capilograph 1B supplied by Toyo Seiki Co., Ltd. in which the strain rate was changed in stages. The measuring temperature was set to about the spinning temperature, and the melt viscosity was 1,216 $s^{-1}$ in Examples and Comparative Examples. It should be noted that the measurement was started 5 min after feeding a specimen into a heating furnace and performed in a nitrogen atmosphere.

B. Fineness

The weight of a 100 m specimen of a sea-island composite fiber was measured and multiplied by 100 to calculate its fineness. This was repeated 10 times, and the arithmetic average was calculated and rounded off to the nearest tenth to determine the fineness.

C. Mechanical Characteristics of Fiber

A Tensilon Tester UCT-100 tensile tester supplied by Orientec Co., Ltd. was used to obtain a stress-strain curve of the fiber under the conditions of a specimen length of 20 cm and a tension speed of 100%/min. The load at break was measured and the load was divided by the initial fineness to calculate the strength while the strain at break was measured, divided by the initial length, and multiplied by 100 to calculate the elongation. For both properties, the above procedures were repeated five times, and their arithmetic averages were calculated. The calculations were rounded off to the nearest tenth for the strength and to the nearest whole number for the elongation.

D. Island Domain Diameter and Variation in Island Domain Diameter (CV %)

A specimen of the sea-island composite fiber was embedded in epoxy resin, frozen by an FC-4E type cryosectioning system supplied by Reichert, cut by a Reichert-Nissei Ultracut N (ultramicrotome) equipped with a diamond knife, and photographed by a H-7100FA transmission electron microscope (TEM) supplied by Hitachi, Ltd., at a magnification where 150 or more islands were observed. If 150 or more islands are not contained in a cross section of one composite fiber filament, a plurality of composite fiber filaments were photographed so that a total of 150 or more islands were contained in their cross sections. From these photographs, 150 island domains were selected randomly and the diameters of all island domains were measured using image processing software (WINROOF), followed by calculating the average and standard deviation. From these results, the variation in island domain diameter CV % was calculated by the following equation:

Variation in island domain diameter (%)=(standard deviation/average)×100. For all these calculations, measurements were made at 10 positions in each photograph, and the 10 measurements were averaged. The island domain diameter was measured to the first decimal place and rounded off to the nearest whole number, while the variation in island domain diameter was rounded off to the nearest tenth. The island domain diameter and the variation in island diameter are represented by these average values.

E. Evaluation of the Arrangement of Island Domains

Figure 3:
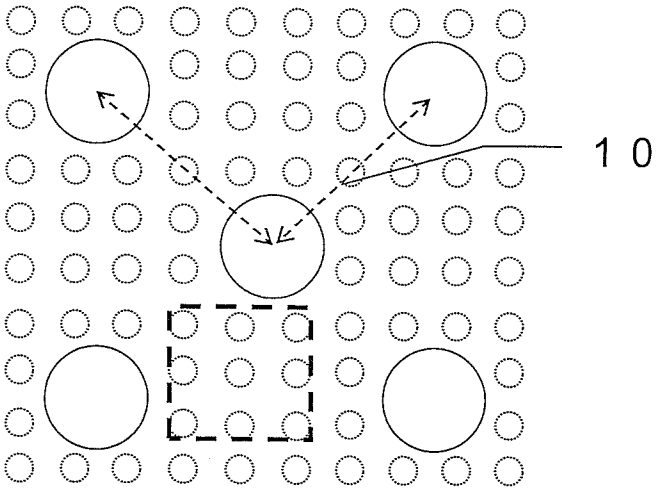
FIG. 3 is an explanatory diagram showing distances among island domains (an exemplary cross section of the sea-island composite fiber).

Assuming that the center of an island domain is represented by the center of the circle circumscribed on the island domain, the island-to-island distance is defined as the distance between the centers of two adjacent island domains as indicated by 10 in FIGS. 3 and 11 in FIG. 4. For this evaluation, a cross section of a sea-island composite fiber is photographed two-dimensionally by the same method as that for the island domain diameter described above, and the island-to-island distance is determined for randomly selected 100 positions. When 100 or more island-to-island distance distances were not observable in one composite fiber cross section, many composite fiber cross sections were photographed to obtain 100 island-to-island distance measurements. The variation in island-to-island distance is calculated from the average and standard deviation of the island-to-island distance by the equation "variation in island-to-island distance (island-to-island distance CV %)=(standard deviation of island-to-island distance/average of island-to-island distance)×100(%)," and rounded off to the nearest tenth. For the evaluation, ten images were photographed by the same procedure, and the arithmetic average of the 10 measurements was used to evaluate the variation in island-to-island distance. The island-to-island distance is represented by this average value.

F. Evaluation of the Coming-Off of Ultrafine Fiber (Island Component) During Sea Removal Treatment Knitted fabrics of sea-island composite fibers were prepared under different spinning conditions and each fabric sample was immersed in a sea removal bath (bath ratio 1:100) containing a solvent suitable to dissolve the sea component and remove 99% or more of the sea component.

The undermentioned evaluation was carried out to examine the degree of the coming-off of ultrafine fiber.

A 100 ml portion is sampled from the solvent used for the sea removal treatment, and this solvent sample is passed through a glass fiber filter with a retained particle diameter of 0.5 μm. Based on the difference in dry weight of the filter between before and after the treatment, the degree of the coming-off of ultrafine fiber was evaluated in four ranks as described below.

◎ (free of coming-off): The weight difference is less than 3 mg.

○ (slight degree of coming-off): The weight difference is 3 mg or more and less than 7 mg.

Δ (moderate degree of coming-off): The weight difference is 7 mg or more and less than 10 mg.

x (serious degree of coming-off): The weight difference is 10 mg or more.

G. Evaluation of Texture

Circular knitted fabrics were produced from the resulting fibers. A combined filament yarn prepared by removing 99% or more of the sea component using a solvent suitable to remove the sea component (bath ratio 1:100) was used to produce a circular knitted fabric sample, which was left to stand for 24 hours or more in an atmosphere of 25° C. and 55% RH and then subjected to sensory evaluation of the slimy feel characteristic of nanofiber by five testers according to the following four-rank criteria. The results of the sensory evaluation performed by five testers were averaged to represent the texture of the fabric under evaluation.

◎ (excellent): A slimy feel is felt strongly, and the entire knitted fabric has a smooth surface with excellent texture.

○ (good): A slimy feel is felt, and the fabric has good texture.

Δ (fair): A slimy feel is felt, but the sample partially has stiff or rough texture.

x (poor): A slimy feel is not felt, and the entire fabric has stiff or rough texture.

H. Evaluation of Color Development

Circular knitted fabrics were produced from the resulting fibers. A combined filament yarn prepared by removing 99% or more of the sea component using a solvent suitable to remove the sea component (bath ratio 1:100) was used to produce a circular knitted fabric, which was dyed by immersing it for 60 min in a bath with a ratio bath of 1:30 containing an 130° C. aqueous solution of a disperse dye (10% owf, Sumikaron Black S-BB, supplied by Sumitomo Chemical Co., Ltd.), 0.5 cc/l of acetic acid, and 0.2 g/l of sodium acetate, and then subjected to reduction cleaning by a common method for 20 min in a 80° C. aqueous solution containing 2 g/l of hydrosulfite, 2 g/l of sodium hydroxide, and 2 g/l of a nonionic active agent (Sandet G-900), followed by rinsing and drying. After the dyeing, the resulting circular knitted fabric (15% weight-reduced) was subjected to L*-value measurement using a spectrophotometric colorimeter (Minolta CM-3700D) under the conditions of a measuring diameter of 8 mm, use of light source D65, and a field of view of 10°. Three measurements were made and its average, $L_{ave}$*, was used for three-rank evaluation according to the following criteria:

○ (good): less than 14

Δ (acceptable): 14 or more and less than 16 x (unacceptable): 16 or more.

Example 1

Polyethylene terephthalate (PET1, melt viscosity 160 Pa·s) used as island component and PET copolymerized with 8.0 mol % of 5-sodium sulfoisophthalic acid (copolymerized PET1, melt viscosity 95 Pa·s) used as sea component were separately melted at 290° C., weighed, and supplied to a spinning pack containing a composite spinneret designed as illustrated in FIG. 5 to discharge a composite polymer flow from the discharge hole. The distribution plate located immediately above the discharge plate contains 790 distribution holes per discharge hole for the island component, of which 720 holes are normal distribution holes 17-(*a*) (hole size: diameter 0.20 mm) and 70 holes are enlarged distribution holes 17-(*c*) (hole size: diameter 0.65 mm), which are arranged in a pattern as illustrated in FIG. 7-(*a*). The annular groove used for the sea component, which is indicated by 21 in FIG. 6, had one distribution hole per 1° in the circumferential direction. Each discharge introduction hole had a length of 5 mm, and each squeezing hole had an angle of 60°. Each discharge hole had a diameter of 0.5 mm and the ratio of the discharge hole length to the discharge hole diameter was 1.5. The sea and island components had a composite ratio of 20/80, and the discharged composite polymer flow was cooled for solidification, treated with an oil solution, and winding-up at a spinning speed of 1,500 m/min to provide a 200 dtex-15 filament fiber (total throughput rate 30 g/min). The as-spun fiber thus wound up was drawn 4.0 times at a drawing speed of 800 m/min between rollers heated at 90° C. and 130° C. A 50 dtex-15 filament drawn fiber was obtained. The sea-island composite fiber had a cross section that includes regularly arranged island domains with large diameters and island domains with small diameters. Accordingly, the fiber obtained was so high in drawability that yarn breakage did not take place in any spindle when subjected to sampling for 4.5 hours by a 10-spindle drawing machine.

The sea-island composite fiber had mechanical properties including a strength of 3.7 cN/dtex and an elongation of 30%.

Figure 8:
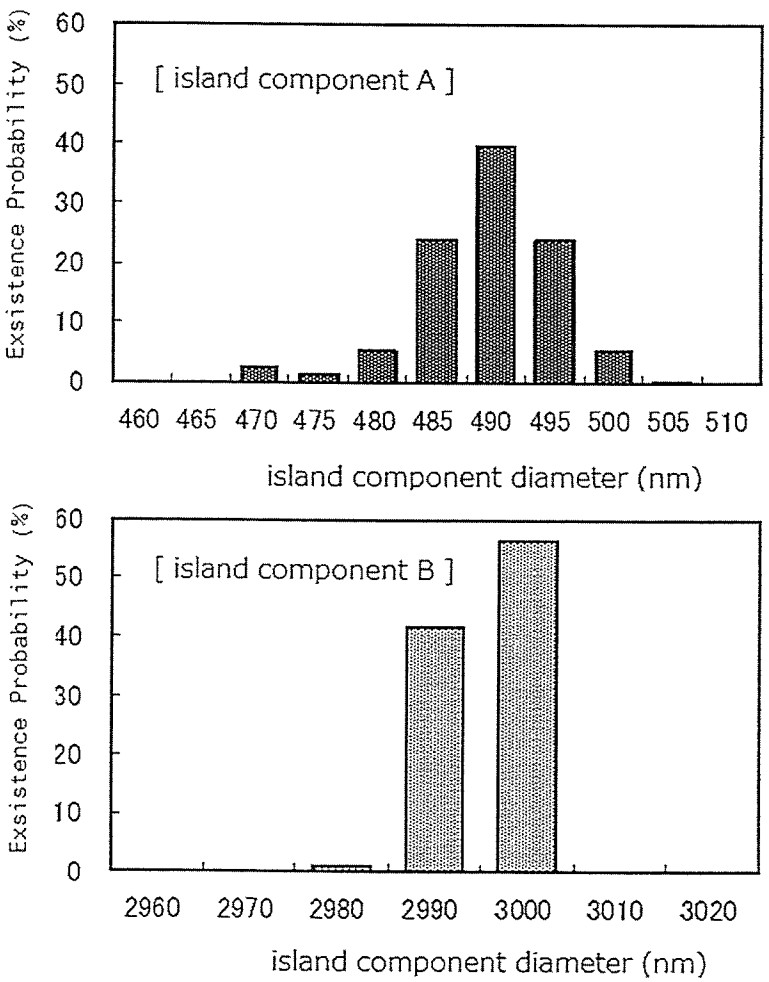
FIG. 8 gives evaluation results for the island domain diameter distribution in a cross section of the sea-island composite fiber.

Observation of a cross section of the sea-island composite fiber showed that the small-diameter island component (island component A) had a diameter of 490 nm with a variation in island diameter of 5.3%, while the large-diameter island component (island component B) had a diameter of 3,000 nm. Results of observation of island diameter distribution are shown in FIG. 8, indicating that island component A and island component B had very narrow distributions.

The variation in island-to-island distance of island component A and island component B was 2.1% on average, indicating an arrangement with little variation in the intervals between the island domains. In an observed sea-island cross section, island component A was found to be disposed regularly around island component B as illustrated in FIG. 7-(*a*).

A sea-island composite fiber sample obtained in Example 1 was immersed in a 1 wt % sodium hydroxide aqueous solution heated at 90° C. to remove 99% or more of the sea component. The sea-island composite fiber prepared in Example 1 contained regularly arranged island domains (small variation for island component) as described above, and accordingly, sea removal treatment took place efficiently in a low-concentration aqueous alkali solution. Consequently, the island component was not degraded significantly, and the coming-off of ultrafine fiber did not took place during the sea removal treatment (evaluated as ◎) for coming-off). Observation of the cross section of the combined filament yarn after removal of the sea component showed that island component A was disposed regularly around island component B, indicating the absence of partial unevenness in the distribution of island component A or island component B. As a result, the circular knitted fabric produced from this combined filament yarn had a slimy feel characteristic of nanofiber as well as a very smooth surface while maintaining resilience and bending strength (texture evaluation ◎). When this circular knitted fabric was dyed, it was found to have good color development property (color development evaluation ○). Results are given in Table 1.

Examples 2 to 4

Except that the sea and island components had a composite ratio of 30/70 (Example 2), 50/50 (Example 3), or 70/30 (Example 4), the same procedure as in Example 1 was carried out. As seen from Table 1, evaluation results of these sea-island composite fibers show that they are high in spinnability and post-processability as in the case of Example 1, and the cross sections of the combined filament yarns had no partial unevenness in the distribution of island component A or island component B. The texture evaluation shows acceptable results, although slight surface roughness was found in Example 3 and Example 4.

accordingly, a slight amount of nanofiber came off during the sea removal treatment, though at an ignorable level. Results are given in Table 2.

Example 6

The same procedure as in Example 1 was carried out using the same distribution plate as in Example 1 except that spinning was performed with a total through-put rate of 35.0 g/min and a sea-island composite ratio of 20/80 and that the resulting as-spun fiber was drawn at a draw ratio of 3.0.

Results show that the observed cross section of the combined filament yarn after the removal of the sea component island contained component A regularly arranged around island component B which had a diameter of 3,800 nm. The combined filament yarn produced from the sea-island composite fiber prepared in Example 6 had a very good color development property, and as compared to Example 1, the degree of whitishness further decreased, resulting in a fabric with a very deep color. Results are given in Table 2.

TABLE 1

| | | | Example 1 | Example 2 | Example 3 | Example 4 |
|---|---|---|---|---|---|---|
| Polymer | Sea | — | Copolymerized PET1 | Copolymerized PET1 | Copolymerized PET1 | Copolymerized PET1 |
| | Island | — | PET1 | PET1 | PET1 | PET1 |
| Sea-island ratio | Sea | % | 20 | 30 | 50 | 70 |
| | Island | % | 80 | 70 | 50 | 30 |
| Spinneret | Island component A | Island/G | 720 | 720 | 720 | 720 |
| | Island component B | Island/G | 70 | 70 | 70 | 70 |
| | Number of g's | — | 15 | 15 | 15 | 15 |
| Sea-island composite fiber | Fineness | dtex | 50 | 50 | 50 | 50 |
| | Strength | cN/dtex | 3.7 | 3.5 | 2.5 | 2.3 |
| | Elongation | % | 30 | 30 | 29 | 29 |
| Cross section parameter | Diameter of island component A | nm | 490 | 460 | 390 | 300 |
| | Diameter variation of island component A | % | 5.3 | 5.5 | 5.6 | 6.4 |
| | Diameter of island component B | nm | 3,000 | 2800 | 2380 | 1800 |
| | Diameter variation of island component B | % | 4.2 | 4.2 | 4.1 | 4.0 |
| | Island-to-island distance variation | % | 5.1 | 5.5 | 4.5 | 6.3 |
| Post-processability | Coming-off of ultrafine fiber | — | ◎ | ◎ | ◎ | ○ |
| Combined filament yarn evaluation | Texture evaluation | — | ◎ | ◎ | ○ | Δ |
| | Color development evaluation | — | ○ | ○ | ○ | ○ |
| Note | | | | | | |

Example 5

The same procedure as in Example 1 was carried out using the same distribution plate as in Example 1 except that spinning was performed with a total through-put rate of 12.5 g/min and a sea-island composite ratio of 80/20 and that the resulting as-spun fiber was drawn at a draw ratio of 3.5. Incidentally, the same level of spinnability as in Example 1 is seen in Example 5 in spite of a decrease in the total through-put rate, which is considered to be attributable to a regular arrangement of the island component.

In the cross section of the sea-island composite fiber obtained in Example 5, island component A, which had a small diameter variation of 7.0% in spite of a largely decreased diameter of 170 nm, was regularly arranged among island component B. As compared to Example 1, island component A had a largely decreased diameter, and Example 7

The same procedure as in Example 1 was carried out using a distribution plate that had a hole arrangement as illustrated in FIG. 7-(*a*) and contained a total of 415 distribution holes for the island components per discharge hole. Incidentally, the distribution plate used in Example 7 has 410 distribution holes 17-(*a*) (hole size: diameter 0.20 mm) for island component A and 5 enlarged distribution holes 17-(*c*) (hole size: diameter 0.80 mm) for island component B. The sea-island composite fiber obtained in Example 7 contained island component A with a domain diameter of 560 nm regularly arranged around island component B with a domain diameter of 4,500 nm. As compared to Example 1, the combined filament yarn obtained from the sea-island composite fiber prepared in Example 7 had high resilience and bending strength, but had a decreased slimy feel characteristic of nanofiber, though at an ignorable level. Results are given in Table 2.

TABLE 2

| | | | Example 5 | Example 6 | Example 7 |
|---|---|---|---|---|---|
| Polymer | Sea | — | Copolymerized PET1 | Copolymerized PET1 | Copolymerized PET1 |
| | Island | — | PET1 | PET1 | PET1 |
| Sea-island ratio | Sea | % | 80 | 20 | 20 |
| | Island | % | 20 | 80 | 80 |
| Spinneret | Island component A | Island/G | 720 | 720 | 410 |
| | Island component B | Island/G | 70 | 70 | 5 |
| | Number of g's | — | 15 | 15 | 15 |
| Sea-island composite fiber | Fineness | dtex | 24 | 78 | 50 |
| | Strength | cN/dtex | 1.8 | 3.3 | 3.8 |
| | Elongation | % | 23 | 36 | 30 |
| Cross section parameter | Diameter of island component A | nm | 170 | 620 | 560 |
| | Diameter variation of island component A | % | 7.0 | 5.9 | 4.9 |
| | Diameter of island component B | nm | 1040 | 3800 | 4500 |
| | Diameter variation of island component B | % | 4.5 | 4.5 | 4.0 |
| | Island-to-island distance variation | % | 10.3 | 7.0 | 6.6 |
| Post-processability | Coming-off of ultrafine fiber | — | ○ | ◎ | ○ |
| Combined filament yarn evaluation | Texture evaluation | — | ○ | ○ | Δ |
| | Color development evaluation | — | ○ | ○ | ○ |
| Note | | | | | |

Example 8

The distribution plate used had a hole arrangement as illustrated in FIG. 7-(*b*). The distribution plate used in Example 8 has a total of 1,550 distribution holes for the island components per discharge hole, of which 1,500 distribution holes 17-(*a*) (hole size: diameter 0.15 mm) are for island component A while 50 enlarged distribution holes 17-(*c*) (hole size: diameter 0.80 mm) are for island component B. In the cross section of the sea-island composite fiber obtained in Example 8, the difference in island diameter between island component A and island component B was 10 or more, but island component A was regularly arranged among domains of island component B. In the combined filament yarn obtained after the removal of the sea component, the space among the domains of island component B was filled with island component A, and as compared to Example 1, the layers formed of island component A (nanofiber) were thick, thereby resulting in a fabric with high overall flexibility. Results are given in Table 3.

Example 9

The distribution plate used had a hole arrangement as illustrated in FIG. 7-(*c*). The distribution plate used in Example 9 had no enlarged distribution holes and had a total of 1,000 distribution holes (hole size: diameter 0.2 mm) for the island components per discharge hole, and except for using this distribution plate, the same procedure as in Example 1 was carried out. As illustrated in FIG. 7-(*c*), the distribution plate used in Example 9 is partially provided with four distribution holes for the island components. Accordingly, the polymer discharged in droplets from the distribution plate relaxed elastically to undergo fusion with adjacent island droplets to cause the formation of large-diameter island domains (island component B), thereby meeting the requirements for a sea-island composite fiber. Furthermore, close observation of island component B after the removal of the sea component showed that island component B had formed a quatrefoil-shaped cross section with four concave portions resulting from the heat history during the discharge step, with island component A being fixed on these concave portions. It was found that island component A and island component B united with each other in this structure and formed a fabric with combined slimy and smooth feel and that the cross-sectional feature of the island component served to control the fabric characteristics. Results are given in Table 3.

Example 10

Based on the design concept of the distribution plate used in Example 9, no enlarged distribution holes were used, but 1,000 distribution holes (hole size: diameter 0.2 mm) for the island components were produced per discharge hole. Of these, 100 island component distribution holes were formed densely in the central portion of the group while the remaining 900 holes were regularly arranged around them. Such a distribution plate was used to carry out the procedure according to the conditions of Example 1.

The sea-island composite fiber obtained in Example 10 had a cross section of a core-in-sheath structure that contained island component A with a domain diameter of 490 nm regularly arranged around domains of island component B with a diameter of 4,900 nm. In regard to sea component removal, island component A and island component B had largely different island diameters, and accordingly, a slight amount of island component A was found to have come off, though at an ignorable level. Observation of island component B after the removal of the sea component showed that it had numerous concave portions which seemed likely to have resulted from the heat history during the discharge step, as in the case of Example 9. Due to the regular arrangement developed in the stage of sea-island composite fiber formation, among others, this combined filament yarn had a structure in which numerous domains of island component A were fixed on the surface of island component B. As compared to Example 1, the slimy feel characteristic of nanofiber tended to deteriorate, though not significantly. On the other hand, the existence of fine concave portions of island component B and the existence of gaps among domains of island component A in sheath portions had synergy effect in forming a pseudo-porous structure and, accordingly, light was absorbed in the surface layer instead of being reflected, resulting in a high rank in the color development evaluation and the formation of a fabric with a very deep color. Results are given in Table 3.

TABLE 3

| | | | Example 8 | Example 9 | Example 10 |
|---|---|---|---|---|---|
| Polymer | Sea | — | Copolymerized PET1 | Copolymerized PET1 | Copolymerized PET1 |
| | Island | — | PET1 | PET1 | PET1 |
| Sea-island ratio | Sea | % | 80 | 20 | 20 |
| | Island | % | 20 | 80 | 80 |
| Spinneret | Island component A | Island/G | 1500 | 1000 | 1000 |
| | Island component B | Island/G | 50 | (4 proximate holes) | (100 proximate holes) |
| | Number of g's | — | 15 | 15 | 15 |
| Sea-island composite fiber | Fineness | dtex | 50 | 50 | 50 |
| | Strength | cN/dtex | 3.7 | 3.4 | 4.2 |
| | Elongation | % | 30 | 30 | 34 |
| Cross section parameter | Diameter of island component A | nm | 350 | 490 | 490 |
| | Diameter variation of island component A | % | 6.5 | 5.6 | 5.3 |
| | Diameter of island component B | nm | 4,000 | 985 | 4900 |
| | Diameter variation of island component B | % | 4.9 | 10.5 | 3.0 |
| | Island-to-island distance variation | % | 10.5 | 12.0 | 8.4 |
| Post-processability | Coming-off of ultrafine fiber | — | ○ | ◎ | Δ |
| Combined filament yarn evaluation | Texture evaluation | — | ◎ | ○ | Δ |
| | Color development evaluation | — | ○ | ○ | ○ |
| Note | | | Highly flexible | Island component B has quatrefoil cross section. | Island A and island B form core sheath structure. |

Comparative Example 1

First, to obtain a sea-island composite fiber to be processed by after-intermingling, a yarn was produced by a conventional known pipe type sea-island composite spinneret (500 islands per discharge hole) as described in Japanese Unexamined Patent Publication (Kokai) No. 2001-192924, and spinning was carried out under the same spinning conditions as in Example 1. The spinning was able to be performed without problems such as yarn breakage, but in the drawing step, yarn breakage attributable to non-uniformity of the cross section took place in two spindles during a 4.5-hours sampling period. In addition, probably due to an excessively high island ratio (island ratio 80%) as observed in cross sections of a sea-island composite fiber in the yarn produced, large-scale confluences of island component flows took place, failing to form an appropriate sea-island cross-sectional structure. In response to the results, a study was carried out aiming to identify good conditions to avoid confluence of the island component flows, and it was found that the confluence of the island component flows can be substantially prevented when the mixing ratio of the sea and island components is 50/50. Accordingly, the sea-island composite fiber production process was carried out again under completely the same conditions as in Example 1 except that the mixing ratio was 50/50. Results of this spinning showed that a fiber nearly equivalent to the one containing island component A formed in Example 3 was obtained as a result of the decreased island ratio, but it had a significantly large variation in island diameter as a result of turbulence in the cross section caused by instable discharge of the island component. Furthermore, the low island proportion, that is, the high sea proportion, led to a slightly disturbed island domain arrangement and a large variation in island-to-island distance.

Then, PET1, that is, the material used as the island component, was spun through a common spinneret having 12 holes with a diameter of 0.3 (L/D=1.5) at a spinning speed 1,500 m/min to prepare an as-spun fiber, which was then drawn at a draw ratio of 2.5 under the same conditions as in Example 1 to provide a 40-dtex, 12-filament single yarn of PET1. The single yarn was combined with the aforementioned sea-island composite fiber and fed to rollers equipped with a wind-up apparatus to provide an after-intermingled yarn. The after-intermingling step was performed at a low rate of 200 m/min, but the single yarn often coiled around the supply roller or the guide roller of the wind-up apparatus (the properties of the after-intermingled yarn included a fineness of 90 dtex, strength of 2.2 cN/dtex, and elongation of 24%).

This after-intermingled yarn was processed into a circular knitted fabric and subjected to sea component removal treatment, where significant coming-off of fiber took place during sea removal treatment due to a variation in the island domain diameter in the sea-island composite fiber (fiber removal evaluation: x). Then, the cross section of the combined filament yarn obtained after the removal of the sea component was observed and results showed that partially concentrated existence of fiber filaments with small diameters took place according to the history of sea-island composite fiber arrangement, and as compared to our fibers, the compatibility between the fiber filaments with large diameters and the fiber filaments with small diameters was poor. Consequently, fiber filaments with large diameters were concentrated near the surface of the combined filament yarn, and when subjected to texture evaluation, the slimy feature characteristic of nano fiber was much poorer as compared to our yarn (texture evaluation: x). Due to the aforementioned uneven distribution of fiber, furthermore, the fabric suffered from uneven color distribution, resulting in poor color development property as compared to our yarn (color development evaluation: x). Results are given in Table 4.

Comparative Example 2

Except for using a sea-island spinneret (including a plate for island component (300 islands) and a plate for sea component) in which the nozzle for each component had a retention portion and a back pressure application portion as described in Japanese Unexamined Patent Publication (Kokai) No. HEI-8-158144 and controlling the mixing ratio of the sea and island components to 50/50, completely the same procedure as in Example 1 was carried out. Note that for Comparative Example 2, it was found that a mixing ratio of 20/80 led to the fusion of a plurality of island domains and the difficulty in forming island domains of 1,000 nm or less and, therefore, the island ratio was decreased to 50% for performing the spinning. Furthermore, the island domains were not distributed uniformly in the sea-island cross section. Accordingly, running-out (breakage) of the single yarn took place once during the spinning step and yarn breakage took place once in four spindles during the drawing step, indicating poor drawability.

Results of the evaluation of the sea-island composite fiber obtained in Comparative Example 2 are shown in Table 4. Observation showed that its island diameter distribution contained a plurality of peaks, which are located adjacently, resulting in a very broad distribution. It was also found that only some of the island domains thus formed had diameters of slightly below 1,000 nm.

This sea-island composite fiber obtained in Comparative Example 2 was processed into a circular knitted fabric and subjected to sea component removal treatment. However, because of a large variation in island diameter, it was impossible to identify optimum sea removal conditions, and a large amount of the island component was degraded and came off (fiber coming-off evaluation: x). Texture evaluation was carried out as in Example 1, and results showed that the fiber did not have a slimy feel because a large part of the fiber was accounted for by fiber filaments with large diameters and that the fabric had a rough feel because of coexistence partially ruptured fiber (texture evaluation: x). With respect to color development, the fiber was ranked as "good (○)" in the color development evaluation because of random distribution of large diameter fiber domains, but close observation showed that the fabric had streaks. Results are given in Table 4.

TABLE 4

| | | | Comparative Example 1 | Comparative Example 2 |
|---|---|---|---|---|
| Polymer | Sea | — | Copolymerized PET1 | Copolymerized PET1 |
| | Island | — | PET1 | PET1 |
| Sea-island ratio | Sea | % | 50 | 50 |
| | Island | % | 50 | 50 |
| Spinneret | Island component | Island/G | 500 | 300 |
| | Number of g's | — | 15 | 15 |
| Sea-island composite fiber | Fineness | dtex | 50 | 50 |
| | Strength | cN/dtex | 2.4 | 2.0 |
| | Elongation | % | 21 | 24 |
| Cross section parameter | Island component · Diameter | nm | 500 | 1185 |
| | Island component · diameter variation | % | 17.0 | 30.0 |
| | Island-to-island distance variation | % | 17.6 | Evaluation Impossible |
| Combined filament yarn evaluation | Texture evaluation | — | X | X |
| | Color development evaluation | — | X | X |
| Note | | | Uneven color development | Broad island diameter distribution |

Example 11

Except for using a spinning speed of 3,000 m/min and a draw ratio of 3.0, the same procedure as in Example 1 was carried out.

It was found from Example 11 that our sea-island composite fiber showed high spinnability because of regular arrangement of island domains in the fiber cross section and that a yarn was produced without breakage as in the case of Example 1 even when the overall draft (spinning+drawing) was increased 1.5 times that in Example 1. In view of the fact that yarn breakage took place in Comparative Example 1 and Comparative Example 2 where the overall draft was about the same as that in Example 1, this high spinnability must be attributable to our excellent effect. From the results given in Table 5, it was also found that the yarn obtained had mechanical characteristics equivalent to those in Example 1 although relatively harsh yarn production conditions were used for multicomponent fiber spinning in Example 11. Results are given in Table 5.

Example 12

As compared to Example 1, the distribution plate used had 100 distribution holes (hole size: diameter 0.2 mm) for island component A per discharge hole, 10 distribution holes (hole size: diameter 0.65 mm) for island component B per discharge hole, and 100 groups per spinneret, and the discharge plate used had 100 discharge holes with a diameter of 0.3 (L/D=1.5). Except for these, the same procedure as in Example 1 was carried out.

The fiber obtained in Example 12 had the same level of spinnability as in Example 1, and yarn production was carried out without problems such as single yarn breakage in the spinning and drawing steps. In general, if the number of filaments is increased while maintaining the through-put rate constant, the single-fiber fineness of the sea-island composite fiber tends to decrease, leading to deterioration in spinnability. In Example 11, however, it is found that the regular arrangement of island component A and island component B serves to maintain stable spinnability even when the fineness is as low as ⅙ that in Example 1. Results are given in Table 5.

Example 13

FIG. 7-(*d*) illustrates the basic hole arrangement of the distribution plate, which has 1,000 distribution holes (hole size: diameter 0.2 mm) per discharge hole. The distribution plate used contains 10 sets of 4 mutually proximate distribution holes (island component B) for island component B, 10 sets of 16 mutually proximate distribution holes (island component C), and 800 holes (isolated holes) for island component A. Except that a PET component (copolymerized PET2 with a melt viscosity of 140 Pa·s), copolymerized with 5.0 mol % of 5-sodium sulfoisophthalic acid, was used as sea component and drawing was performed at a draw ratio of 2.7, completely the same procedure as in Example 1 was carried out.

Observation of the island diameter distribution in Example 13 showed that island component A, island component B, and island component C had separate distributions. Results are given in Table 5.

Example 14

Except for using a distribution plate that was similar to the one used in Example 13, but had additional 5 sets of mutually proximate 32 distribution holes for island component D and a decreased number of 640 holes (isolated holes) for island component A, completely the same procedure as in Example 1 was carried out.

Observation of the island diameter distribution in Example 14 showed that island component A, island component B, island component C, and island component D had separate distributions. Results are given in Table 5.

TABLE 5

| | | | Example 11 | Example 12 | Example 13 | Example 14 |
|---|---|---|---|---|---|---|
| Polymer | Sea | — | Copolymerized PET1 | Copolymerized PET1 | Copolymerized PET2 | Copolymerized PET2 |
| | Island | — | PET1 | PET1 | PET1 | PET1 |
| Sea-island ratio | Sea | % | 20 | 20 | 30 | 30 |
| | Island | % | 80 | 80 | 70 | 70 |
| Spinneret | Island component A | Island/G | 720 | 100 | 1,000 holes in total (800) | 1,000 holes in total (640) |
| | Island component B | Island/G | 70 | 10 | (10 sets of 4 proximate holes) | (10 sets of 4 proximate holes) |
| | Island component C | Island/G | — | — | (10 sets of 16 proximate holes) | (10 sets of 16 proximate holes) |
| | Island component D | Island/G | — | — | — | (5 sets of 32 proximate holes) |
| | Number of g's | — | 15 | 100 | 15 | 15 |
| Sea-island composite fiber | Fineness | dtex | 34 | 50 | 74 | 74 |
| | Strength | cN/dtex | 4.0 | 3.4 | 2.7 | 2.9 |
| | Elongation | % | 22 | 34 | 34 | 30 |
| Cross section Parameter | Diameter of island component A | nm | 400 | 510 | 460 | 275 |
| | Diameter variation of island component A | % | 5.0 | 5.0 | 6.3 | 8.1 |
| | Diameter of island component B | nm | 2400 | 1030 | 920 | 550 |
| | Diameter variation of island component B | % | 4.0 | 3.9 | 8.5 | 8.3 |
| | Diameter of island component C | nm | — | — | 1820 | 780 |
| | Diameter variation of island component C | % | — | — | 10.1 | 9.1 |
| | Diameter of island component D | nm | — | — | — | 1100 |
| | Diameter variation of island component D | % | — | — | — | 12.0 |
| | Island-to-island distance variation | % | 5.3 | 7.0 | 13.0 | 12.0 |
| Post-processability | Coming-off of ultrafine Fiber | — | ○ | ◎ | ◎ | ○ |
| Combined filament yarn evaluation | Texture evaluation | — | ○ | ◎ | Δ | ○ |
| | Color development evaluation | — | ○ | ○ | ○ | ○ |
| Note | | | | | 3 peaks in island diameter distribution. Better color development than in Example 1 | 4 peaks in island diameter distribution. Better color development than in Example 13. |

Example 15

Except for using nylon 6 (N6, melt viscosity 190 Pa·s) as island component, polylactic acid (PLA, melt viscosity 100 Pa·s) as sea component, a spinning temperature of 260° C., and a draw ratio of 2.5, completely the same procedure as in Example 1 was carried out.

Though containing PLA as sea component, the sea-island composite fiber obtained in Example 15 showed high spinnability because regularly arranged N6 (island component) domains bore the stress. Furthermore, in spite of the sea component of PLA, the fiber had the same level of quality as that in Example 1 in terms of the cross-sectional structure, uniformity, and post-processability. Results are given in Table 6.

Example 16

Using polybutylene terephthalate (PBT, melt viscosity 120 Pa·s) as island component and polylactic acid (PLA, melt viscosity: 110 Pa·s), that is, the same material as in Example 15, as sea component, spinning was carried out at a spinning temperature of 255° C. and a spinning rate of 1,300 m/min. The draw ratio was 3.2, and except for these, the spinning was carried out under the same conditions as in Example 1.

In Example 16, spinning and drawing were carried out without problems, and in spite of the island component of PBT, the fiber had the same level of quality as that in Example 1 in terms of the cross-sectional structure, uniformity, and post-processability. Results are given in Table 6.

Example 17

Polyphenylene sulfide (PPS, melt viscosity 180 Pa·s) was used as island component while high-molecular weight polyethylene terephthalate (PET2, melt viscosity 240 Pa·s) produced by solid phase polymerization at 220° C. of the PET used in Example 1 was used as sea component to perform spinning at a spinning temperature of 310° C. Except that the as-spun fiber was drawn in two stages by heated rollers at 90° C., 130° C., and 230° C. at a total draw ratio of 3.0, the same procedure as in Example 1 was carried out.

In Example 17, spinning and drawing were carried out without problems, and in spite of the island component of PPS, the fiber had the same level of quality as that in Example 1 in terms of the cross-sectional structure, uniformity, and post-processability. The as-prepared sea-island composite fiber obtained in Example 17 can serve as a filter with high chemical resistance. To confirm its potential as a high performance (high dust-collecting performance) filter, it was immersed in 5 wt % sodium hydroxide aqueous solution to carry out sea removal treatment for 99% or more removal of the sea component. Containing PPS as island component, this combined filament yarn was high in alkali resistance and had a structure suitable for high performance filters in which PPS fiber with a large fiber diameter acted as a support for the surrounding PPS nanofiber. Results are given in Table 6.

TABLE 6

| | | | Example 15 | Example 16 | Example 17 |
|---|---|---|---|---|---|
| Polymer | Sea | — | PLA | PLA | PET2 |
| | Island | — | N6 | PBT | PPS |
| Sea-island ratio | Sea | % | 20 | 20 | 20 |
| | Island | % | 80 | 80 | 80 |
| Spinneret | Island component A | Island/G | 720 | 720 | 720 |
| | Island component B | Island/G | 70 | 70 | 70 |
| | Number of g's | — | 15 | 15 | 15 |
| Sea-island composite fiber | Fineness | dtex | 80 | 63 | 67 |
| | Strength | cN/dtex | 2.5 | 2.1 | 4.4 |
| | Elongation | % | 30 | 33 | 25 |
| Cross section parameter | Diameter of island component A | nm | 690 | 600 | 640 |
| | Diameter variation of island component A | % | 5.9 | 6.1 | 7.0 |
| | Diameter of island component B | nm | 1300 | 1150 | 1250 |
| | Diameter variation of island component B | % | 4.0 | 4.5 | 4.8 |
| | Island-to-island distance variation | % | 5.6 | 6.7 | 7.5 |
| Post-processability | Coming-off of ultrafine fiber | — | ◎ | ◎ | ◎ |
| Note | | | | | |

The invention claimed is:

1. A sea-island composite fiber having a cross section containing a plurality of island components having different island diameters, at least one of the island components having island diameters of 10 to 1,000 nm with a diameter variation of 1.0 to 20.0%, differences in island diameter among the island components are 300 to 3,000 nm and a variation in a distance between centers of adjacent island domains with the same diameter being 1.0 to 20%.

2. The sea-island composite fiber as specified in claim 1, wherein island component A having island diameters of 10 to 1,000 nm is disposed around island component B having island diameters of 1,000 to 4,000 nm.

3. A combined filament yarn produced by removing a sea component from sea-island composite fiber specified in claim 1.

4. A fiber product at least partially comprising fiber specified in claim 1.

5. A combined filament yarn produced by removing a sea component from sea-island composite fiber specified in claim 2.

6. A fiber product at least partially comprising fiber specified in claim 2.

7. A fiber product at least partially comprising fiber specified in claim 3.

* * * * *